United States Patent [19]

Urich et al.

[11] Patent Number: 4,773,601

[45] Date of Patent: Sep. 27, 1988

[54] COMBINATION SMALL-SCALE TUB GRINDER AND WOOD CHIPPER

[75] Inventors: Oren D. Urich, Windsor; Ralph T. O'Donnell, Loveland; Roy D. Cash, Greeley, all of Colo.

[73] Assignee: S.B.O., Inc., Greeley, Colo.

[21] Appl. No.: 912,257

[22] Filed: Sep. 29, 1986

[51] Int. Cl.[4] ..... B02C 13/282

[52] U.S. Cl. ..... 241/101.7; 241/186.4; 241/189 R

[58] Field of Search ..... 241/101.7, 73, 189 R, 241/186.4, 186 R, 194, 195, 190, 98, 79, 79.1

[56] References Cited

U.S. PATENT DOCUMENTS

| | | | |
|---|---|---|---|
| 2,650,745 | 9/1953 | Oberwortman . | |
| 2,810,529 | 10/1957 | Jensen . | |
| 3,615,059 | 10/1971 | Moeller . | |
| 3,743,191 | 7/1973 | Anderson . | |
| 3,912,175 | 10/1975 | Anderson . | |
| 3,966,128 | 6/1976 | Anderson et al. . | |
| 4,003,502 | 1/1977 | Barcell . | |
| 4,087,051 | 5/1978 | Moeller | 241/190 X |
| 4,106,706 | 8/1978 | Burrows . | |
| 4,232,719 | 11/1980 | Payton | 241/101.7 X |
| 4,266,899 | 5/1981 | Skeem | 241/101.7 X |
| 4,449,672 | 5/1984 | Morlock et al. | 241/101.7 |

OTHER PUBLICATIONS

W. W. Grinder, Inc.
C. Q. Concho, Lindig Manufacturing Corp.
Promark Model 310 Brush Chipper.
Alko International.

*Primary Examiner*—Mark Rosenbaum
*Attorney, Agent, or Firm*—James R. Young

[57] ABSTRACT

A mini-sized hammer mill apparatus is adaptable for both rotatable tub feeding of hay, fodder, feed grains, and the like, as well as for chute feeding of wood and debris for comminution. A number of features optimize the mini size for effective, reliable, and smooth operation by small horsepower tractors, including: side feed tangentially out of a cylindrical hopper under a rotatable tub into the periphery of a large diameter, narrow rotor, or through a chute with tensioned roller feeder; radially adjustable grinding and metering finger/grate bar combination, secondary grinding fingers and breaker bar, self-sharpening hook-like pointed hammers, rotatable tub mounting structure, and enhanced energy dissipating, down-sized cyclone with reverse-louvered pressure dissipators.

51 Claims, 9 Drawing Sheets

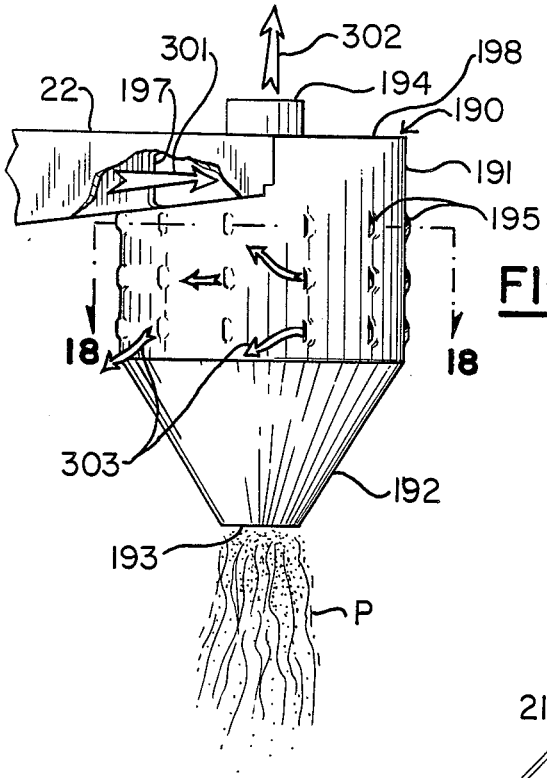
FIG. 17
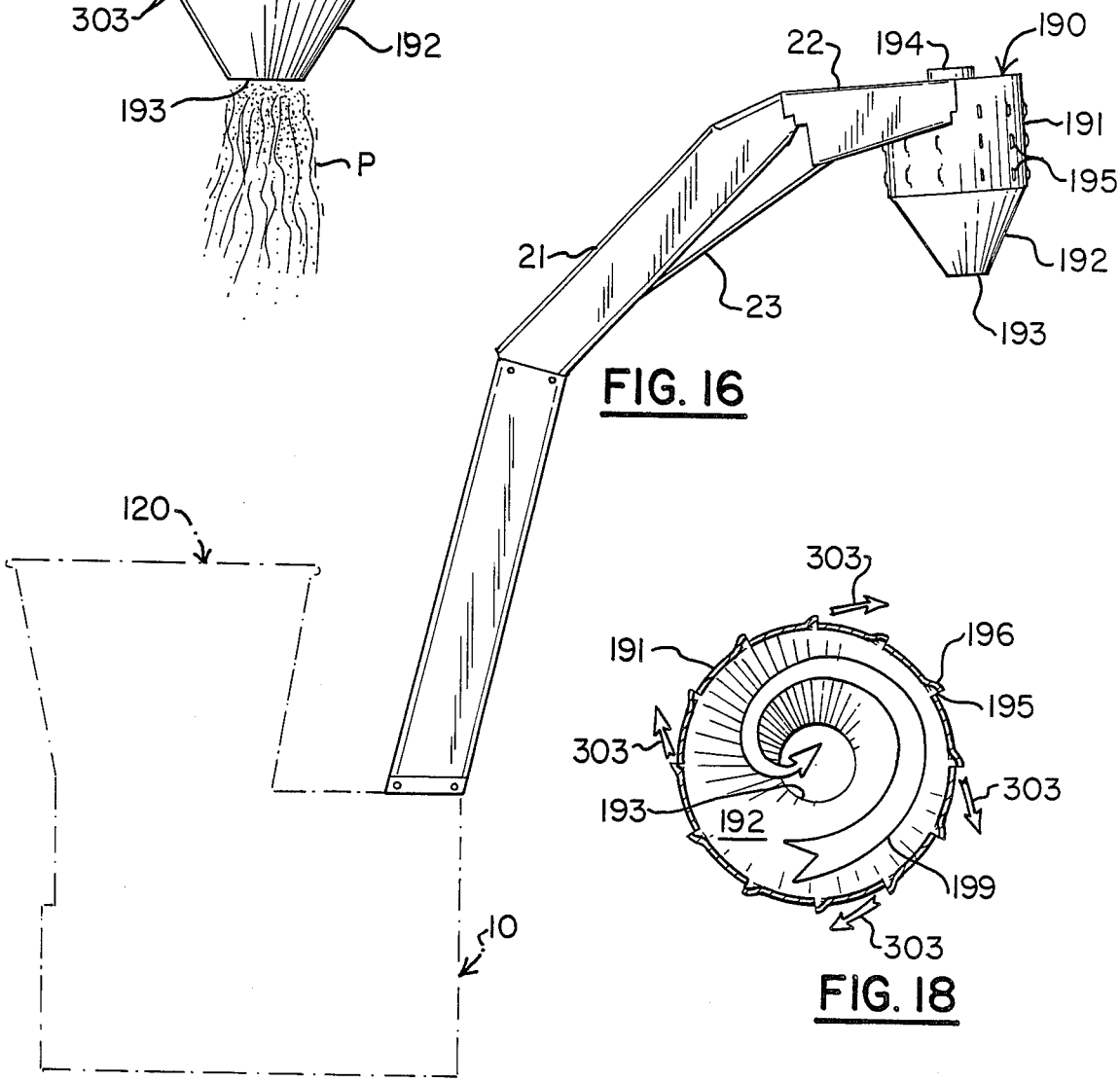
FIG. 16
FIG. 18

COMBINATION SMALL-SCALE TUB GRINDER AND WOOD CHIPPER

BACKGROUND

1. Field of Invention

The present invention is generally related to comminuting (grinder) apparatus, and more specifically to a combination small-scale tub grinder and wood chipper and specific features that improve such apparatus.

2. Description of the Prior Art

Grinding grains, corn, hay, forage, and roughage products for more effective and digestible livestock feed is an old and well-known process. There are many kinds of machines for grinding or comminuting such products, including, for example stone mills, burr mills, hammer mills, roller mills, and others. Because of the fibrous and stalky, nature of hay, straw, and other roughages, hammer mill type grinders are generally considered to be the most effective for comminuting these forage or roughage materials; however, handling and feeding hay into a hammer mill in a uniform manner without much tedious manual labor has presented problems.

In the last two or three decades, machines generically known as tub grinders have become popular for comminuting hay, straw, and other roughages, because they are designed to feed very large bales of hay into hammer mill apparatus without excessive manual labor. In such tub grinders, the bales of hay or other roughage material are gradually fed into a hammer mill by a large rotating tub. The hammer mill is positioned on the floor or bottom of the tub, and the rotating tub rotates the bottom of the bale over the hammer mill. The hammers on the hammer mill rotating at a high angular velocity chew off the hay on the bottom of the bale as the bales rotates over the hammer mill in the floor of the tub. Typical examples of such tub grinders are shown in the following patents: U.S. Pat. No. 2,659,745, issued to W. Wortman; U.S. Pat. No. 3,615,059, issued to E. Moeller; U.S. Pat. No. 3,743,191, issued to R. Anderson; U.S. Pat. No. 3,912,175, issued to R. Anderson; U.S. Pat. No. 3,966,128, issued to J. Anderson, et. al.; U.S. Pat. No. 4,003,502, issued to E. Barcell; U.S. Pat. No. 4,087,051, issued to C. Moeller; and U.S. Pat. No. 4,106,706, issued to H. Burrows.

Such tub grinders are effective, but they are very large and relatively expensive machines that require high-powered tractors or stationary engines for sufficient power to operate them. This situation leaves smaller scale livestock feeding operators and hobby livestock feeders, who typically have only low horsepower tractors and limited funds, without any effective hay comminuting capability other than perhaps hand-feeding hay into smaller hammer mills.

While the solution to this problem at first glance appeared to be merely reducing the conventional large tub grinders in scale, it was really not so simple. Many components of large tub grinders that function well with large bales and powerful tractors do not function so well with small bales and limited horsepower. For example, a hammer mill rotor cannot be scaled down so small that it has insufficient weight and inertia, even if the tub is scaled down to handle conventional, man-sized square or round bales. Yet, a smaller tub cannot accommodate a larger hammer mill in the same manner as a larger tub can. Further, even though hay bales can be smaller in size, the hay is the same and is just as tough as hay in large bales to grind. Therefore, in a directly scaled down tub grinder and/or using smaller horsepower tractors, uneven feeding and jamming, as well as slugging the hammer mill and overloading the tractor engine result in nonuniform product and a generally frustrating experience for the operator.

Also, most small-scale operators and hobbiests really cannot afford to have separate grinding machinery for comminuting hay and for milling corn and other feed grains. It is much preferred to have a single machine that can handle roughage, such as hay and straw, as well as all kinds of grains and corn. However, the conventional tub grinders for hay cannot handle grains effectively, while the conventional hammer mills for grains cannot handle hay effectively without laborious and time consuming hand-feeding.

Still further, many small-scale operators also have need for wood chipper machinery for comminuting brush cleared from wooded areas or branches pruned from orchards and trees. Disposal of such brush and branches is easier when they are reduced to chips. There are also a number of beneficial uses for wood chips, such as bedding for livestock, mulch in gardens and around ornamental shrubbery, decorative ground coverings, and the like. Again, however, most small-scale operators cannot afford, or cannot justify economically, owning a separate wood chipper machine, even though they need one on a regular basis.

Prior to this invention, therefore, there was a significant need for a smaller-scale hammer mill machine that could be driven by a small horsepower tractor and that still had the capability and versatility of effectively handling and comminuting both hay and all kinds of corn and feed grains, as well as having the ability to comminute brush and branches into wood chips.

SUMMARY OF THE INVENTION

Accordingly, it is a general object of this invention to provide a small-scale hammer mill that is capable of handling and comminuting hay, corn, and other feed grains, as well as comminuting brush and branches into wood chips.

A more specific object of this invention is to provide a comminuting apparatus with a feeder system that can effectively and uniformly feed hay, as well as corn and other feed grains, into a hammer mill without jamming and slugging so that a small horsepower tractor can be used to drive the apparatus, and good, uniform and acceptable comminuted feed product can be produced.

Another specific object of this invention is to provide a hammer mill that can be used effectively as a wood chipper.

Another specific object of this invention is to provide a hammer mill that can be easily converted from a feed grinding mill to a wood chipper.

Another specific object of this invention is to provide a hammer mill having sufficient feed and milling controls and adjustments to accommodatea variety of comminuting requirements from hay, corn, and grain for livestock feed to brush and branches for wood chips.

Additional objects, advantages, and novel features of this invention are set forth in part in the description that follows, and in part will become apparent to those skilled in the art upon examination of the following specification or may be learned by the practice of the invention. The objects and advantages of the invention may be realized and obtained by means of the instrumentalities and in combinations particularly pointed out in the appended claims.

To achieve the foregoing and other objects and in accordance with the purposes of the present invention, as embodied and broadly described herein, the apparatus of this invention may comprise a rotary hammer mill rotatably mounted in a housing that encloses a milling chamber and apparatus capable of feeding a variety of materials to be comminuted radially into the rotary hammer mill. There are two alternative feeder apparatus that can be conveniently mounted on the hammer mill. One of the feeder assemblies is a tub feeder for handling livestock feed, such as hay, corn, and grains, and the other is a drum feeder for handling brush and branches for wood chipping. A slidably adjustable grinding finger and grate in the feeder area adjacent the rotary hammer mill, along with self-sharpening hooked hammers extending radially from the rotary hammer mill cooperate to provide an even feed of materials into the milling chamber. A set of removeable secondary grinding fingers on the bottom of the milling chamber, along with concaves in close radial spacing of the hammers increase grinding action. The tub feeder has a rotary receptacle over a hopper with spiral sloped floor that moves the material to be comminuted in a downward spiral to an opening into the milling chamber where the material exits the tub tangentially to be directed radially into the rotary hammer mill. An agitator bar, sloped insert for the hopper floor, and grain door enclosure enhance the handling of various kinds of feed materials. The drum feeder has a rotary feed drum with teeth on its peripheral surface positioned in a chute radially adjacent the hammer mill rotor, which drum feeder is biased toward the chute to enhance clamping control and metering of brush and branches radially into the hammer mill rotor. A control bar on the chute is connected to the drum drive for conveniently stopping the drum rotation. A cyclone energy dissipator for the outlet spout has a plurality of louvered openings for releasing air in a direction opposite the flow of comminuted material for enhanced deceleration of the comminuted product that is propelled by the hammer mill rotor out of the milling chamber.

BRIEF DESCRIPTION OF THE DRAWINGS

The accompanying drawings, which are incorporated in, and form a part of, the specifications illustrate the preferred embodiments of the invention, and together with the description serve to explain the principles of the invention. In the drawings:

FIG. 16 is a front elevation view of the spout portion of the hammer mill with an improved cyclone pressure dissipator according to this invention mounted thereon;

FIG. 17 is an enlarged front elevation view of the cyclone shown in FIG. 16, with a portion of the spout end section cut away to reveal the inlet to the cyclone pressure dissipator;

FIG. 18 is a sectional view of the cyclone pressure dissipator of the present invention taken substantially along lines 18—18 of FIG. 17;

DETAILED DESCRIPTION OF THE PREFERRED EMBODIMENTS

Figure 1:
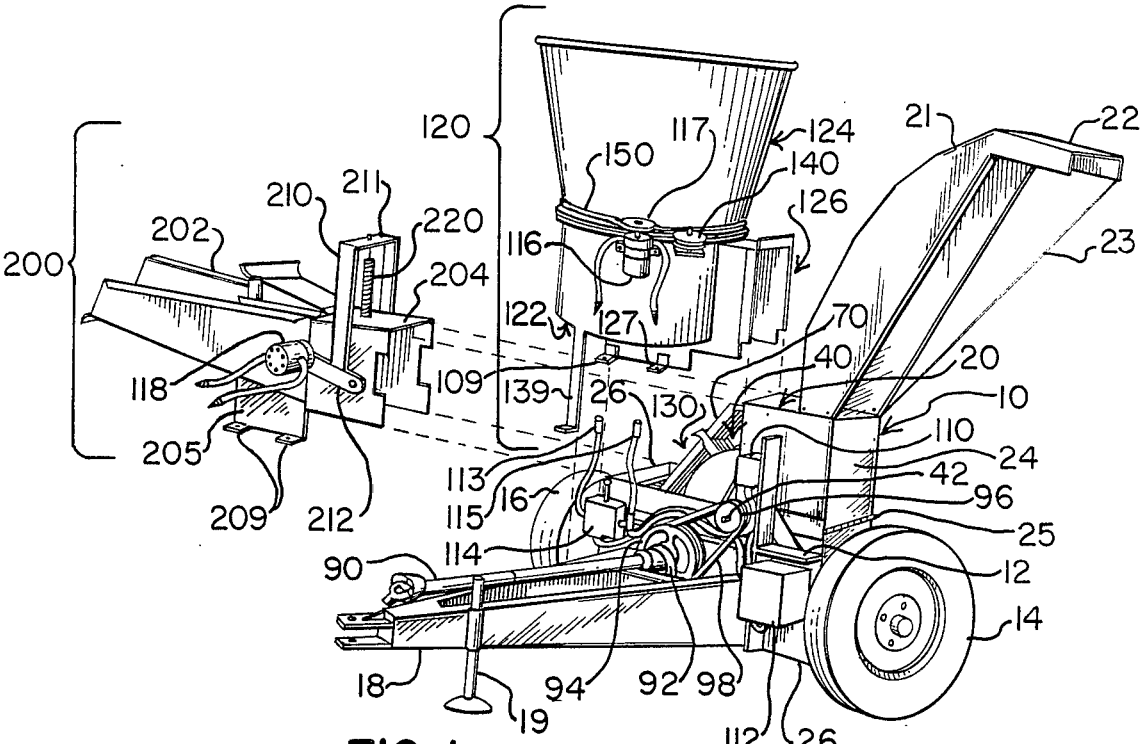
FIG. 1 is a perspective view of the combination tub grinder and wood chipper hammer mill invention according to the present invention, illustrating the interchangeable tub feeder and wood feeder components removed from, but in proximity to, the base hammer mill apparatus.

The improved small-scale, all-purpose hammer mill according to the present invention is illustrated in FIG. 1 with the base hammer mill assembly 10 mounted on a pair of wheels 14, 16 with a drawbar 18 and a power takeoff shaft 19 adapted for detachable connection to a conventional farm tractor. This hammer mill apparatus 10 is particularly designed and adapted for use with small-horsepower farm tractors and for use in grinding or comminuting a wide variety of livestock feed products, including hay, corn, and grain, as well as for chipping brush and branches for livestock bedding and other purposes.

To accommodate this variety of uses for one relatively small-scale hammer mill apparatus, there is provided as shown in FIG. 1 a tub feeder assembly 120 for mounting on and feeding livestock food products into the hammer mill rotor assembly 40. Also, as shown in FIG. 1, there is provided an alternate wood feeder assembly 200 that is adapted for mounting on the hammer mill assembly 10 as an alternative or substitute for the tub feeder 120. This wood feeder assembly 200 is specially adapted for feeding brush and branches into the hammer mill 10 for producing wood chips.

Figure 2:
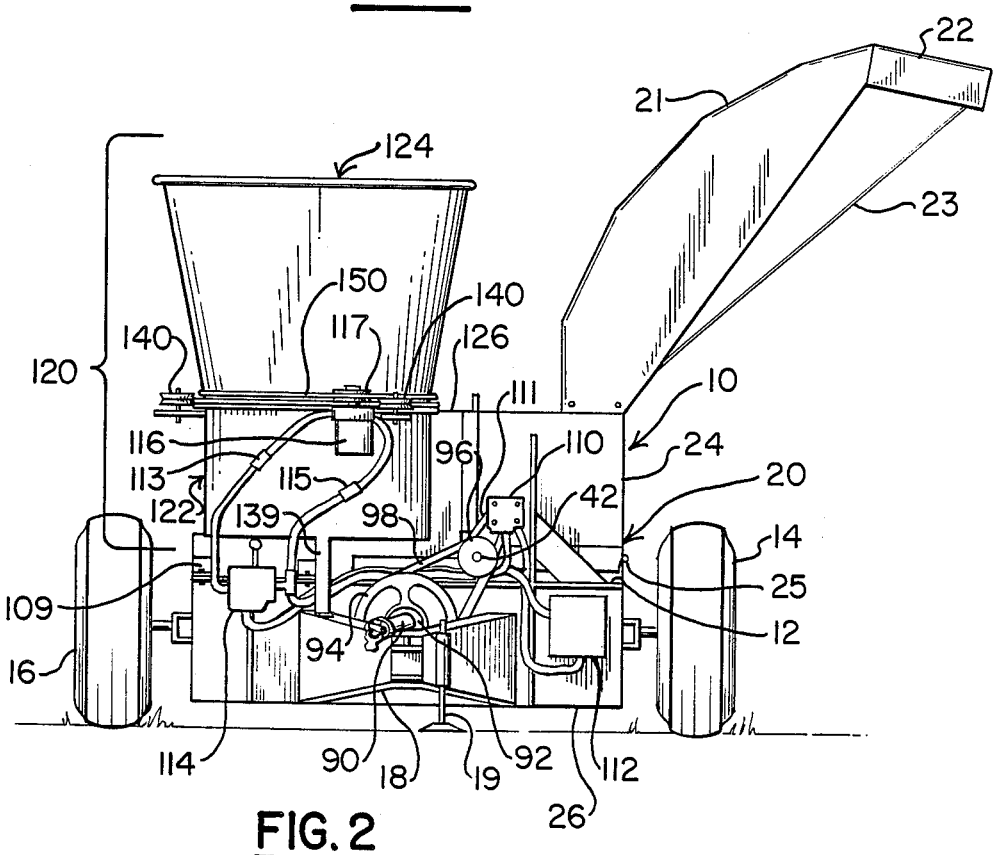
FIG. 2 is a front elevation view of the hammer mill apparatus according to the present invention with the tub feeder assembly mounted thereon.
Figure 3:
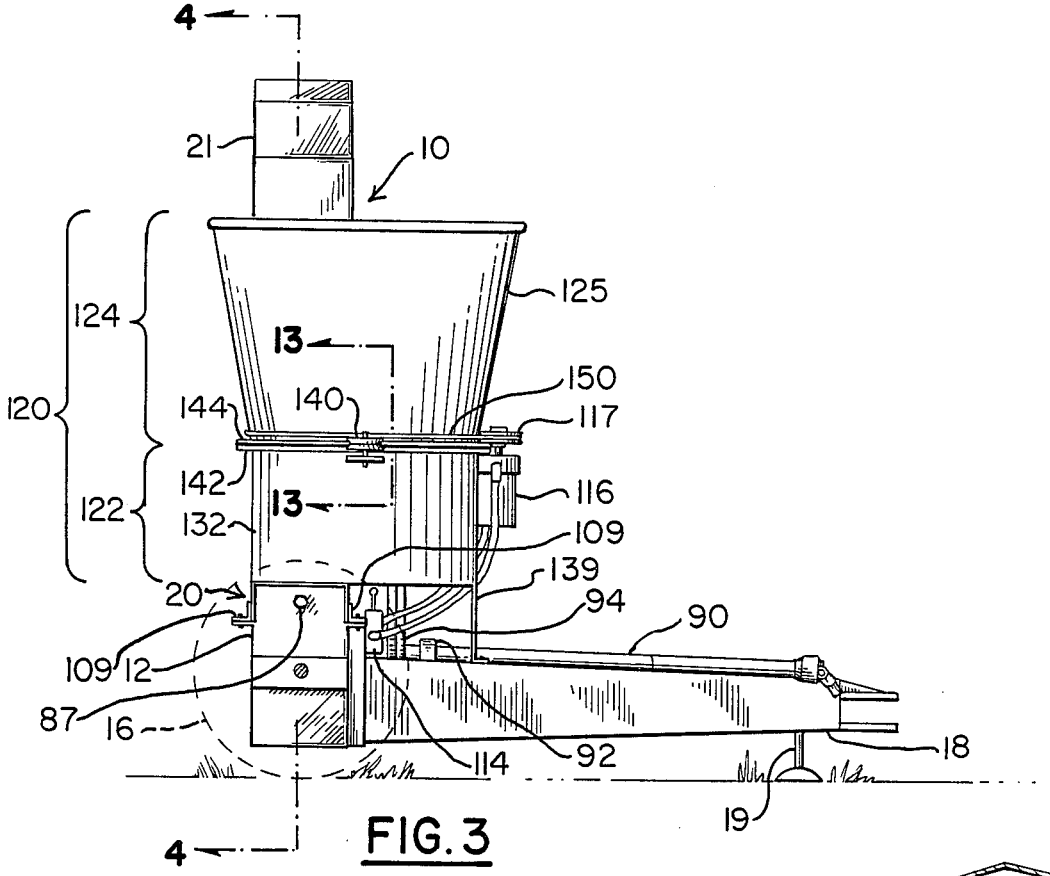
FIG. 3 is a right side elevation view of the hammer mill apparatus according to the present invention with the tub feeder assembly mounted thereon.
Figure 4:
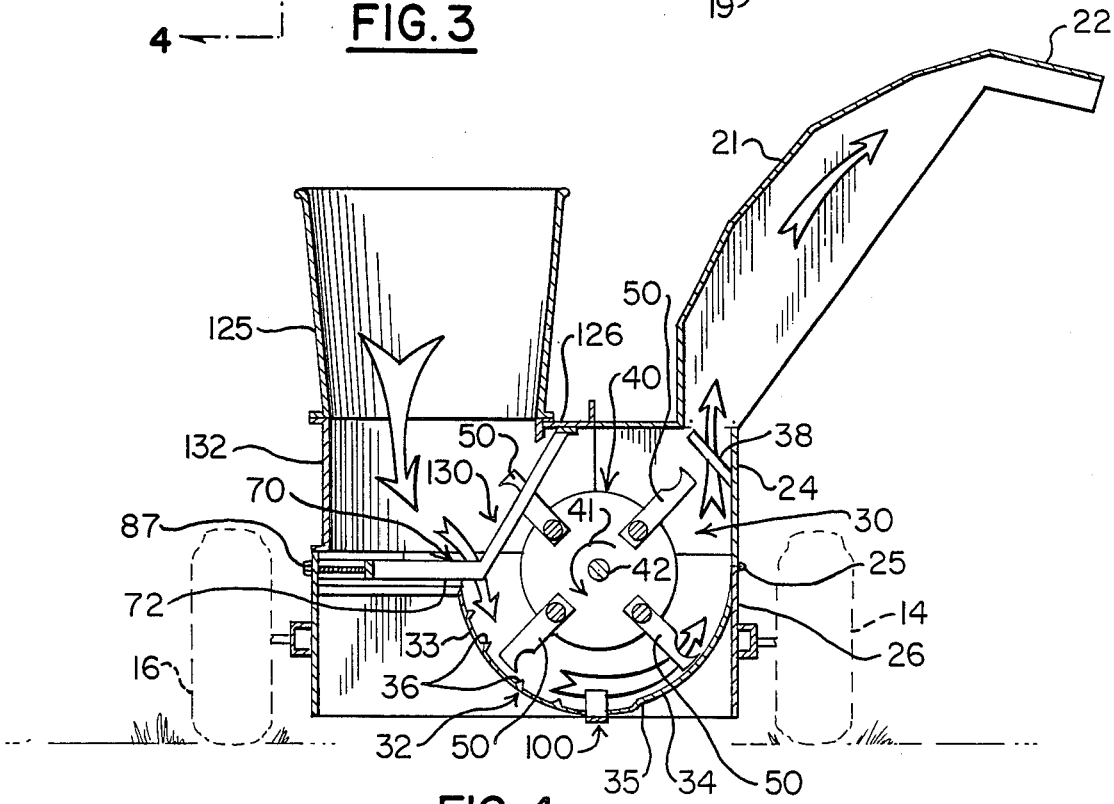
FIG. 4 is a cross-sectional view of the hammer mill apparatus according to this invention taken along lines 4—4 of FIG. 3.

The hammer mill assembly 10 according to the present invention is illustrated in FIGS. 2 through 4 with the tub feeder assembly 120 mounted thereon. A detailed description of the basic components of the hammer mill assembly 10 is best made by reference initially to these FIGS. 2 through 4 along with FIG. 1.

As briefly mentioned above, the hammer mill assembly 10 has a main frame 12 and housing 20 mounted on a pair of wheels 14, 16 with a drawbar 18 extending forwardly thereof for attachment to a farm tractor (not shown). A drawbar stand 19 is illustrated to support the front end of the drawbar 18 when it is not attached to a tractor. A spout 21 with an adjustable end section and adjusting rod 23 are attached to the top portion 24 of the housing 20 for directing the finished ground feed or wood chip products to an appropriate receptacle or storage area (not shown).

The top portion 24 of the housing 20 is pivotally connected to the bottom portion 26 by a hinge 25 and combines with the bottom portion of the housing 26 to partially enclose a milling chamber 30. As best shown in FIG. 4, the bottom of the milling chamber 30 is enclosed by a curved bottom wall 32 that is slightly larger in radius than the maximum radius of the components of the hammer mill rotor assembly 40. As also best shown in FIG. 4, the hammer mill rotor assembly 40 is mounted for rotation in the direction indicated by arrow 41 about its main shaft 42.

Referring now again to FIGS. 1 and 2, the hammer mill rotor assembly 40 is driven by a multiple V-belt connected to a main pulley 96, which is mounted on the main rotor shaft 42 exterior of the housing. The drive belt 98 is driven by a drive pulley 94 connected to the power takeoff shaft 90 which, as briefly mentioned above, is adapted for releasable attachment to the power takeoff of a tractor. A bearing block 92 supports the rear end of the power takeoff shaft and journals the front end of the counter shaft on which the drive pulley 94 is mounted in a conventional manner.

Also shown in FIGS. 1 and 2 are hydraulic drive components for the tub feeder assembly 120 and for the wood feeder assembly 200. For example, a hydraulic pump 110 is mounted adjacent the main pulley 96 and is driven via belt 111 by a secondary drive pulley (not shown) mounted on the main shaft 42 behind the main pulley 96. A hydraulic fluid reservoir 112 is shown mounted on the lower left portion of the bottom housing section 26, and a control valve assembly 114 is shown mounted on the lower right portion of the housing 26. Appropriate hydraulic lines and fittings are provided to connect these hydraulic components as would be known to persons having ordinary skill in this art. Releaseable connectors 113, 115 are provided for detachably connecting the hydraulic lines to either the hydraulic motor 116 on the tub feeder assembly 120 or the hydraulic motor 118 on the wood feeder assembly 200, to accommodate whichever of these assemblies is being utilized at any particular time on the hammer mill assembly 10.

While this illustration is made and described with hydraulic drive components for the tub feeder assembly 120 and the wood feeder assembly 200, mechanical drives, such as appropriate gear boxes and belt drives can also be provided to drive the tub feeder assembly 120 and the wood feeder assembly 200. However, such alternative mechanical drives are considered to be within the abilities of persons having ordinary skill in the art. Therefore, while these inventors have also provided the hammer mill apparatus of this invention with such mechanical drives, it is not considered necessary to illustrate or describe them in detail for purposes of describing the unique features of this invention.

Referring again primarily to FIG. 4, the unground or raw feed product is introduced into the grinding chamber 30 through opening 130. The hammer assemblies 50 of the rotor assembly 40 engage the incoming product at the opening 130 and tear or force it through a grinding finger and grate assembly 70, thereby pulling the product into the lower curved portion of the grinding chamber 30. In the lower curved portion, the product is ground across a series of concaves 36 protruding inwardly from the primary stage 33 of the curved bottom wall 32, thereby creating additional physical grinding and turbulence in the flow of the product through the grinding chamber 30.

An optional secondary set of grinding fingers 100 are positioned to protrude into the bottom portion of the grinding chamber 30 for additional final breaking and tearing of the product to substantially complete the comminuting process. In order to maximize acceleration of the ground material down stream from the secondary fingers 100 for discharge from the milling chamber 30, the curved bottom wall 32 is bent or transformed upwardly at 35 into a slightly smaller radius closer to the distal ends of the hammer assemblies 50. The comminuted material is then discharged from the grinding chamber 30 into the spout 21. An optional screen 38 can be provided in the discharge area of the grinding chamber 30 so that only particles less than a pre-selected maximum size can be discharged into the spout 21. Any larger particles would be blocked and knocked back into the grinding chamber 30 to be caught again by the hammer assemblies 50 for further grinding.

The hammer mill rotor assembly 40 and the grinding finger and grate assembly 70 are best described by reference to FIGS. 5 and 6. The rotor assembly 40 is comprised of a plurality of hammer assemblies 50 mounted between 2 large circular rotor plates 48, 49. These rotor plates 48, 49 are in turn mounted on a main rotor shaft 42, which is journaled at each end in respective front and rear bearing blocks 44, 46. The bearing blocks 44, 46, are mounted on the respective horizontal front and rear frame members 12 of the hammer mill apparatus 10. The main pulley 96, shown in FIGS. 1 and 2, but not in FIGS. 5 and 6, is mounted on this main shaft 42 for driving the rotor assembly 40 in the angular direction indicated by arrow 41.

Figure 5:
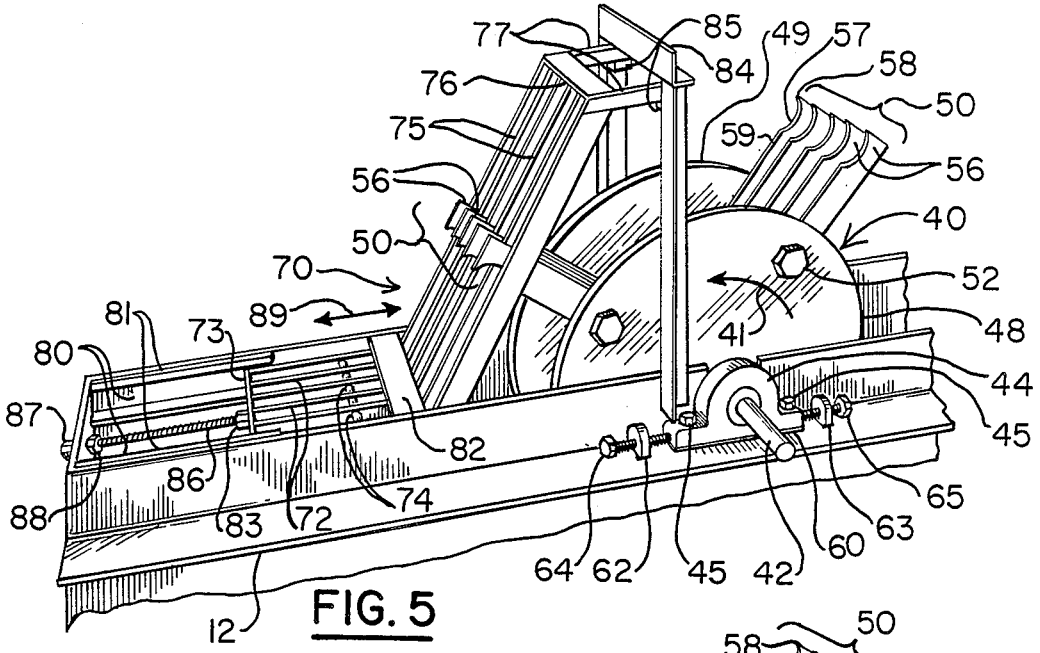
FIG. 5 is an enlarged perspective view of the hammer mill rotor assembly and the preferred embodiment grinding finger and grate assembly according to the present invention, but not showing the exterior housing portions of the hammer mill for clarity of illustration.
Figure 6:
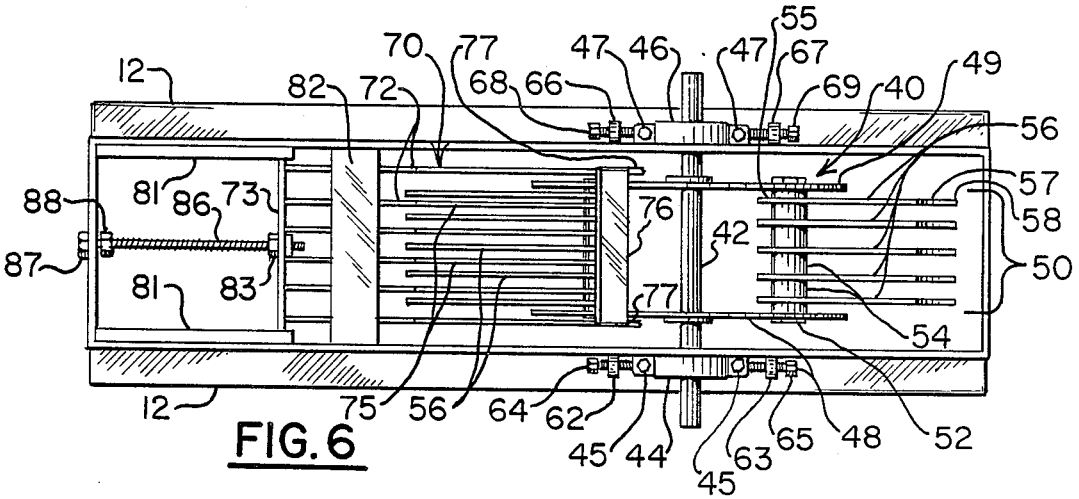
FIG. 6 is a top plan view of the hammer mill rotor assembly and the grinding finger and grate assembly shown in FIG. 5.

Referring now primarily to FIG. 6 with secondary reference to FIG. 5, the hammer assemblies 50 are comprised of a plurality of elongated hammers 56 mounted on a large bolt or pin 54 that extends from the front plate 48 to the back plate 49. The elongated hammers 56 in each assembly 50 are held in spaced-apart relation to each other by spacers 54 mounted on the pin 52 between the hammers 56. This invention is illustrated with 4 hammer assemblies in each rotor assembly 40; however, either more or fewer hammer assemblies can be used, so long as they are evenly spaced around the rotor to maintain the balance of the rotor.

Referring again primarily to FIG. 5 with secondary reference to FIG. 6, each hammer 56 of this invention is in the form of an elongated bar having a proximal end 55 and a distal end 58. The proximal end 55 of each hammer is mounted on a pin 52, and the distal end extends radially outward from the pin to define the outer extremity of the rotor assembly 40. On the leading edge 59 of each hammer 56 adjacent the distal end 58 there is a portion 57 recessed into a leading edge 59. This recessed portion 59 is preferably in the shape of a crescent which returns outwardly to the leading edge approximately at the distal end, thereby forming a partial hook with a point at the distal end 58. This hook point 58, in combination with the recessed portion 57, forms an effective grabbing and tearing mechanism for engaging and pulling smaller bits and portions of the feed product into the grinding chamber 30 without slugging. This feature is particulary effective on chunks of hay, straw, or other very fibrous or stalky materials that are fed into the hammer mill. Without them, such fibrous or stalky materials have a tendency to initially resist entry into the grinding chamber until pushed sufficiently hard when all at once an exceedingly large chunk or slug would be pulled into the milling chamber 30. Larger machines with large horsepower tractors can handle such larger chunks and slugs without jamming the grinder and without stopping the engine on the tractor. However, smaller comminuting apparatus, such as the present invention, which is particularly adapted for use with small horsepower tractors, could not handle such larger chunks of hay. They would most likely slug and jam the hammer mill, overpowering the tractor engine and stopping it.

These hammers 56 of the present invention, however, with the recessed portions 57 curving otwardly to the leading points 58 at the distal ends are more effective to continuously grab and tear smaller bits and pieces of the hay out of the chunks as they are being fed toward the hammer mill chamber 30. With the larger chunks of hay torn into these smaller bits and pieces, a smooth and continuous flow of hay into the hammer mill chamber 30 is maintained without chunks and slugs that could jam the machine and overpower a small tractor.

The points 58 at the distal ends of the hammers 56 are preferably fabricated with a material that is significantly harder and more resistant to wear than the remaining leading edge portion 59 of the hammer 56. This hardened tip feature has the effect of self-sharpening, i.e., keeping the tips or points 58 on the hammers 56 protruding ahead of the recessed portions 57 and preventing them from becoming worn off or dulled to an ineffective rounded configuration. More specifically, since the hardened tips 58 are much less subject to wear and abrasion than the remaining portions of the leading edge 59 and recessed portion 57 of the hammers 56, more wear will tend to occur in the recesses 57 adjacent the harder leading tip 58. Therefore, the natural wear of the hammers striking and grinding the materials to be comminuted has the effect of continuously keeping the hammers 56 selfsharpened so that the hardened tips 58 protrude forwardly ahead of the recessed portions 57.

The grinding finger and grate assembly 70 was also developed specifically for enhancing effective control and metering of raw material into the hammer mill chamber 30 at an effective rate that can be handled by the hammer mill rotor 40 and a small horsepower tractor attached thereto. This grinding finger and grate assembly 70 is preferably adjustable and is comprised of a primary portion having a plurality of horizontal grinding fingers 72 protruding radially into the grinding chamber 30 and a secondary section comprised of a plurality of inclined grate bars 75 extending upwardly from the inward ends of the fingers 72. The plurality of horizontal fingers 72 and inclined grate bars 75 are rigidly assembled as an integral unit with an end frame 73 rigidly affixed to the outer ends of each finger 72 and a top frame 76 rigidly affixed to the upper ends of each grate bar 75. A rod with a plurality of spacers 74 is also positioned between the fingers 72 to help maintain the spacing thereof near the point of initial material tearing and grinding at the opening 130 to the hammer mill chamber 30.

The horizontal fingers 72, as will be described again below in reference to the tub feeder assembly 120, extend into the milling chamber 30 at about the same level as the bottom or floor of the feeder assembly 120. This level is on approximately the same horizontal plane as the axis of rotation of the rotor assembly, i.e., the main rotor shaft 42. Therefore, the raw material to be comminuted is fed radially into the rotor assembly 40 in an area essentially defined by a cylindrical surface subscribed by the distal ends 58 of hammers 56 moving through the quadrant of rotation from the top of the milling chamber 30 to the horizontal plane extending from the fingers 72 through the main shaft 42, with the largest portion of such feeding taking place radially into the rotor assembly 40 immediately above that horizontal plane.

This grinding finger and grate assembly 70 is preferably mounted in the frame 12 in a manner that it can be adjusted inwardly and outwardly toward and away from the rotor assembly 40 as indicated by the double ended arrow 89. Therefore, the grinding finger and grate assembly 70 of this invention is slideably mounted in a pair of inwardly facing channels 80 on the frame 12. The retainer bars 81 at the top of the channels 80 allow the fingers 72 and frame 73 to slide laterally in the channels 80 while preventing vertical movement. The crossbar 82 also retains the forward portion of the fingers 72 from vertical movement, while allowing horizontal sliding movement in the directions indicated by the arrow 89.

A threaded rod 86 extending from the lateral end of frame 12 to the frame 73 of the finger and grate assembly 70 is adapted for adjusting the finger and grate assembly 70 to the desired position and then retaining it there. A threaded nut 83 attached to the frame member 73 mates with the threaded rod 86 for pulling the finger and grate assembly 70 in either direction inwardly and outwardly as indicated by the arrow 89, while the collar 88 maintains the lateral position of the threaded rod 86. A hexagonal head 87 on the threaded rod 86 accommodates the use of a standard wrench for adjusting the finger and grate assembly 70 laterally toward and away from the rotor assembly 40.

Additional support for the upper end of the grate bar 75 is provided by a guide frame 84 extending upwardly from the main frame members 12 of the hammer mill apparatus. A pair of support bars 77 extend from opposite ends of the upper frame member 76 toward the guide frame 84. A pair of guide blocks 85 mounted on the facing inside surfaces of the guide frame 84 slideably retain the guide bars 77 from vertical movement while allowing horizontal sliding movement through the frame 84.

For purposes of illustration, the grinding finger and grate assembly 70 is shown in FIG. 5 retracted its full extent away from the rotor assembly 40, while FIG. 6 shows the finger and grate assembly 70 adjusted or moved inwardly toward the rotor assembly 40.

As mentioned above, as hay or other material is fed toward the rotor assembly 40, the hardened tip 58 of the hammers 56 are the first to contact the material and tear it loose, pulling it into the hammer mill chamber 30. After this initial tearing of the material away from its mass of inherent chunks, the primary comminuting effect of this apparatus takes place at the inward end of the fingers 72 as the hammers 56 force the material between the fingers 72 and into the hammer mill chamber 30. The fingers 72 are of course spaced apart such that the ends 58 of the hammers 56 pass between the inward ends of the fingers 72 pulling the hay material therethrough. Since the rotor assembly 40 spins at a high rate of angular velocity, there is an extreme initial tearing and grinding affect as the hammers force the material between the fingers 72.

The grate bars 75, which incline upwardly from the inward ends of fingers 72, are also spaced apart so that the ends 58 of the hammers 56 can extend through the spaces between the grate bars 75, as best shown in FIG. 5. When the grinding finger and grate assembly 70 is adjusted outwardly away from the rotor assembly 40, the extent to which the hammers 56 protrude through the grate bars 75 is small. Therefore, when a mass of material, such as hay, is fed toward the rotor assembly 40 with the grate bars 75 adjusted more outwardly away from the rotor assembly 40, only a small outer portion of the hammers 56 can contact and tear at the mass of hay. The grate bars 75 are effective to hold back the chunks of hay, thus preventing anything more than the smaller bits and pieces torn by the tips 58 of the hammers 56 from entering the milling chamber 30. On the other hand, when the grinding finger and grate assembly 70 is adjusted inwardly toward the rotor assembly 40, the grate bars 75 allow the hammers 56 to grab and tear larger portions of the mass of hay and force them through the fingers 72 into the milling chamber 30.

Therefore, by adjusting the grinding finger and grate assembly 70 inwardly and outwardly toward and away from the rotor assembly 40, the operator can effectively meter the amount of hay or other material into the hammer mill in a very uniform, continuous rate that can be adjusted to the tractor power available without the likelihood of excessive chunks or slugging that could otherwise occur. This assembly, therefore, makes it possible for an operator to adjust the feed of even fibrous and stalky raw materials, such as hay, straw, and the like, optimum loading and use of a small horsepower tractor to obtain maximum, smooth grinding or comminuting performance with the limited power available.

The grate bars 75 also have a secondary beneficial effect of knocking down and retaining in the hammer mill chamber any larger particles coming around for the second time that could not get through the screen 38 to the spout 21 as described above.

Figure 7:
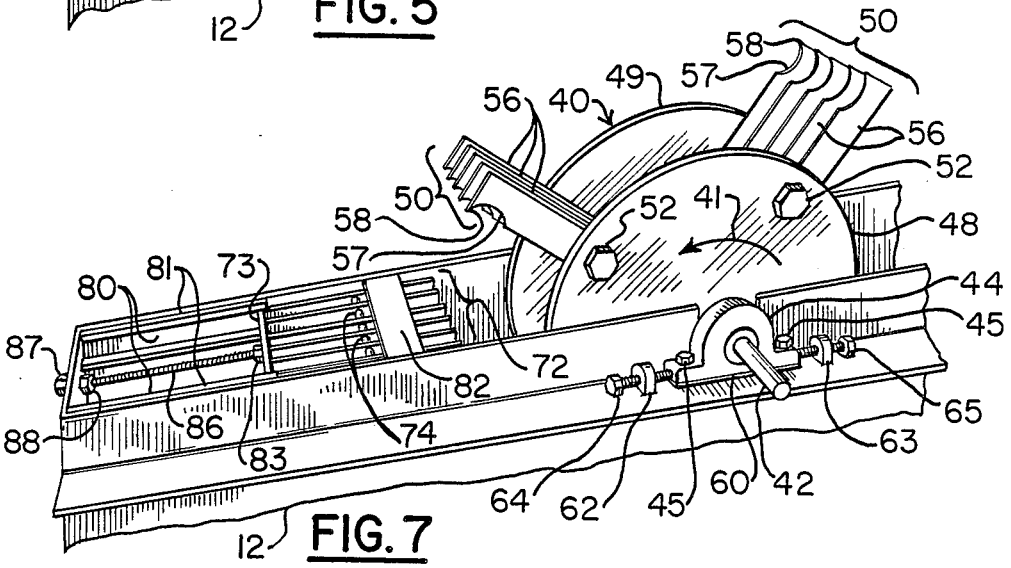
FIG. 7 is a perspective view of the hammer mill rotor assembly and a modified version of the grinding finger assembly according to the present invention.

FIG. 7 illustrates an alternative embodiment which is essentially the same as that illustrated in FIGS. 5 and 6, with the exception that the grate bars 75 are eliminated, leaving only the ends of the grinding fingers 72 protruding into the hammer mill chamber. This embodiment can be used effectively for grinding materials that are less difficult to handle and less subject to slugging, such as small grains, shelled corn, and the like, in which the flow of the material into the hammer mill chamber can be regulated effectively by other features of this invention that will be described below without the necessity of having the grate bars 75 to hold back large chunks or slugs away from the rotor assembly 40.

The rotor assembly adjustments of the hammer mill apparatus according to this invention are best described by primary reference to FIGS. 5 through 7 in combination with secondary reference to FIG. 4. As described above, the rotor assembly 40 is mounted on a main shaft 42 extending from the front side of the hammer mill to the rear side of the hammer mill. This main shaft 42 is journaled in front and rear bearing blocks 44, 46, respectively.

Each bearing block 44, 46 is adjustably mounted on the front and rear horizontal frame members 12. Vertical adjustment and alignment of the rotor assembly 40 can be accomplished by adding or eliminating a number of shims 60 between the bearing block 44 and the frame 12 on the front. A similar vertical adjustment can be made with shims 60 under the rear bearing block 46.

Lateral adjustments of the rotor assembly 40 can be accomplished by loosening the mounting bolts 45 in the front bearing block 44, which extend through the frame 12 in slotted holes (not shown). With the bolts 45 loose, the bearing block 44 can be adjusted laterally by turning set screws 64, 65, which are threaded in respective internally threaded ears 62, 63. Once the proper alignment is obtained, the bolts 45 can then be tightened, along with tightening the set screws 64, 65 against the bearing block 44, to retain it in position. Likewise, the rear bearing block 46 can be adjusted laterally by loosening the bolt 47, and then screwing the set screws 68, 69 in their respective ears 66, 67 to obtain the desired lateral alignment. These rotor assembly adjustments can be made both to attain proper alignment for "squaring up" the rotor to the remaining components of the hammer mill, as well as to adjust the rotor assembly 40 closer to, or farther away from, the concaves 36 and the internal surface of the primary curved bottom housing 33 to affect finer or coarser grinding.

Figure 9:
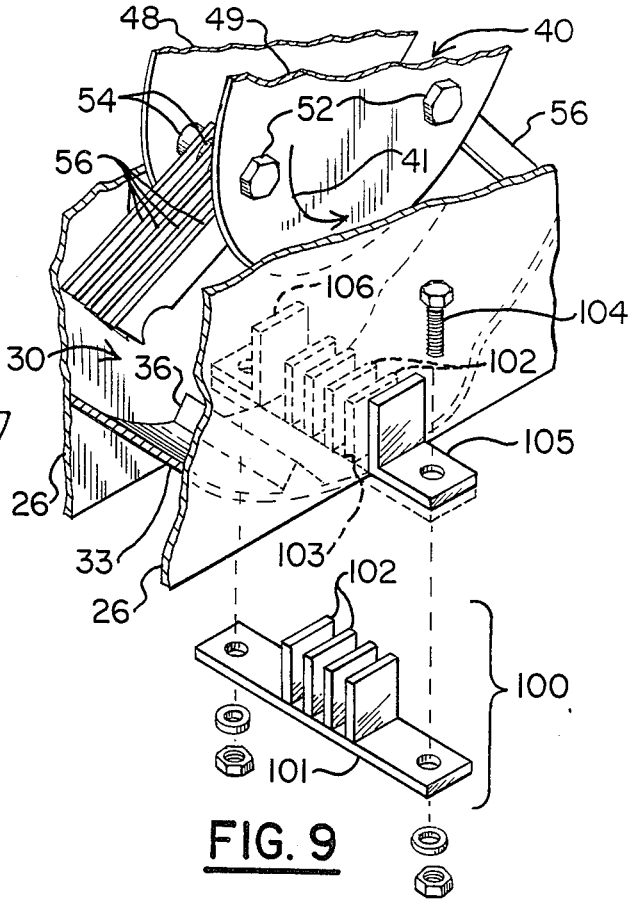
FIG. 9 is an enlarged fragmentary view in perspective of the lower part of the hammer mill housing illustrating a set of removeable secondary grinding fingers.
Figure 8:
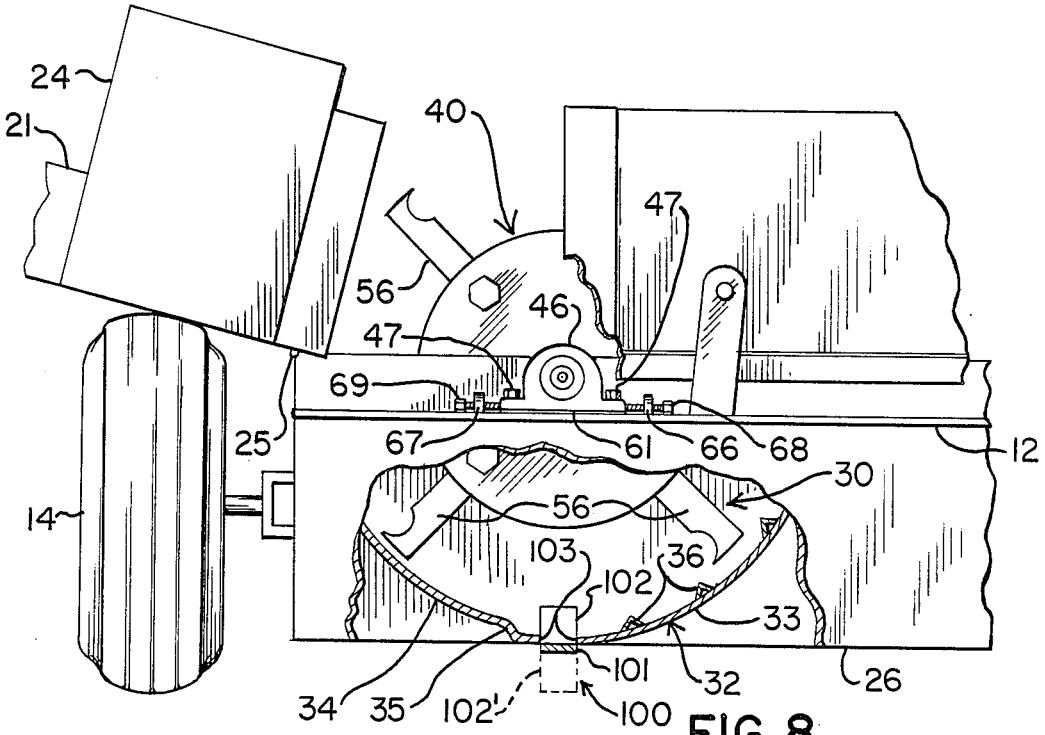
FIG. 8 is a partial enlarged rear elevation view of the hammer mill of the present invention with the upper housing portion pivoted to the open position and with several portions of the housing cut away to reveal the components inside.

The secondary finger assembly 100 is best described with primary reference to FIGS. 8 and 9, and secondary reference to FIG. 4. The secondary finger assembly 100 is comprised of a plurality of short, rectangular fingers 102 rigidly mounted on, and extending upwardly from, a cross bar 101 in spaced apart relation to each other. The spaces between the fingers 102 are sufficient to allow passage therethrough of the hammers 56 on the rotor assembly 40, when the finger assembly 100 is mounted in the bottom of the hammer mill chamber 30, as shown in FIGS. 8 and 9. For mounting in this position, the fingers 102 extend upwardly through an elongated opening 103 in the bottom wall 32 of the milling chamber 30. They are held in that position by bolts 104 extending through mounting ears 105, 106 on the front and rear, respectively, of the housing 26.

The material being processed is, of course, driven along with the hammers 56 through the fingers 102 for additional grinding and comminuting of the material into smaller particles.

If this secondary grinding or comminuting through the secondary fingers 102 is not desired, for example to obtain a coarser finished comminuted product, this secondary grinding finger assembly 100 can be removed, turned upside down and remounted on the same mounting brackets 105, 106 on the bottom of the hammer mill, as shown in FIG. 8. In this alternate, nonuse position, the fingers 102, rather than protruding upwardly into the milling chamber 30, will instead protrude downwardly under the milling chamber as indicated by the broken lines 102' in FIG. 8. In this nonuse position, the plate 101 still closes the opening 103 at the bottom of the curved chamber wall 32 to prevent the premature escape of the material being processed in the hammer mill.

Turning now to the tub feeder assembly 120, initial reference is made to FIGS. 1 through 4. The tub feeder assembly 120 is comprised principally of a cylindrical hopper portion 122 on the bottom, a rotatable receptacle or tub portion 124 on the top, and a housing portion 126 extending laterally outward from the hopper portion 122. The tub feeder assembly is mounted on the hammer mill 10 with the housing portion 126 enclosing and covering the upper portion of the rotor assembly 40 that is not enclosed by the cover portion 24. A pair of mounting brackets 127 on the bottom of the housing portion 126 are adapted for removable attachment to the front on rear horizontal frame members 12 of the hammer mill assembly 10. Another pair of similar mounting brackets 109 under the hopper portion 122 are also removably attachable to the front and rear frame members 12 to secure the tub feeder assembly 120 to the hammer mill apparatus 10.

As discussed briefly above, the hydraulic motor 116 mounted on the side of the hopper portion 122 is connected by couplings 113, 115 to the hydraulic system of the hammer mill apparatus 10, for the purpose of powering the rotation of the tub portion 124. A V-belt 150 passes around a pulley 117 on the hydraulic motor 116 and around the lower periphery of the tub portion 124, so that rotary motion produced by the hydraulic motor 116 is imparted to the rotary tub 124. Starting and stopping the rotation of the tub 124, as well as speed control, can be accomplished by the hydraulic valve 114.

As the tub 124 is rotated, material such as hay, ear corn, grains, or other materials can be deposited into the tub through its open upper end. The rotary motion of the tub 124 helps to drive or feed the material down into the hopper portion 132 and into the opening 130 of the milling chamber 30 for grinding and processing, as described in detail above.

Figure 12:
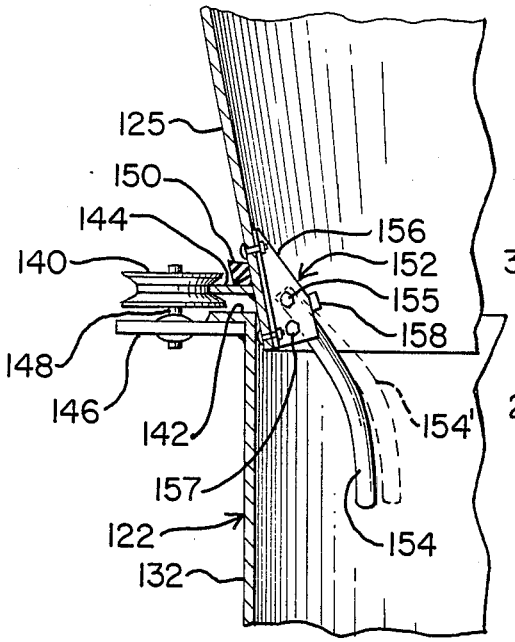
FIG. 12 is a partial sectional view of the rotatable mounting assembly of the tub feeder taken substantially along lines 13—13 of FIG. 3.
Figure 11:
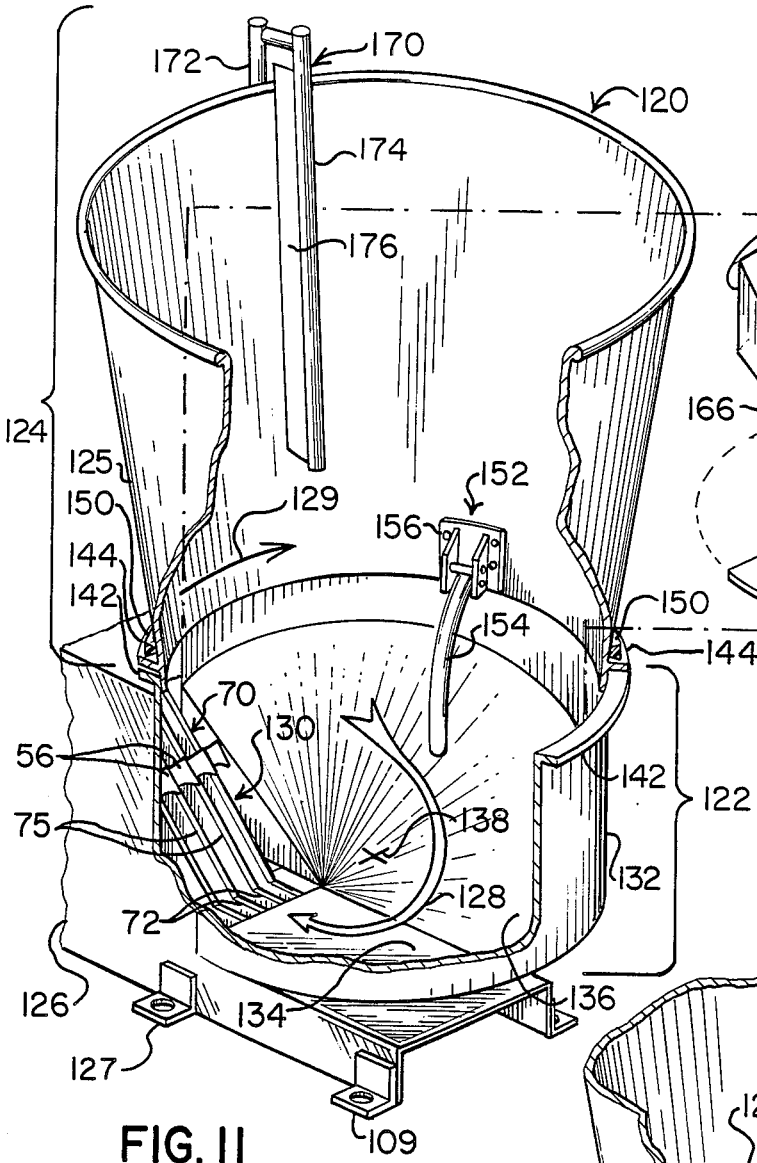
FIG. 11 is another perspective view of the tub feeder assembly of the present invention looking into the tub from the right rear of the apparatus and with portions of the tub and hopper assemblies cut away to reveal the components inside.
Figure 10:
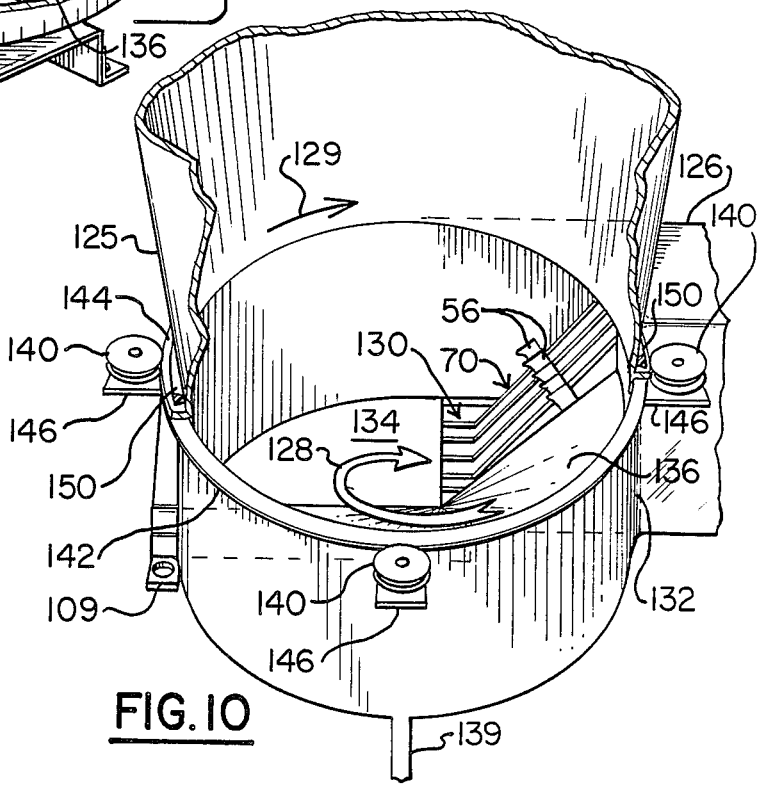
FIG. 10 is an enlarged perspective view looking down from above and the front of the tub feeder assembly of the present invention with a portion of the tub cut away to reveal the lower interior portion of the tub feeder assembly.

Referring now primarily to FIGS. 10 through 12, and secondarily to FIGS. 1 through 4, the lower hopper portion 122 has a cylindrical vertical wall 132. Inside the cylindrical wall 132 is a slanted floor portion 136 that slants in a partial circular configuration around and downward to a partial flat bottom floor portion 134 that leads into the opening 130 to the milling chamber 30. The opening 130 to the milling chamber 30 is partially through a part of the cylindrical wall 132 and into the housing portion 126, the rear side of which continues tangentially from the cylindrical hopper wall 132, and the opening 130 is also partially through a part of the floor 134. In this manner, the hopper 122 with its circularly downward slanted floor portion 136 leading in a downward spiral to the tangential opening 130 into the milling chamber 30 is in the form of a single volute or whorl without an inner partition. A portion of the rotor assembly 40 extends through the opening 130 into the hopper 122.

The slanted floor portion 136 is preferably in the form of a surface generated by a line segment having one end fixed on a point on the radius of the floor of the cylindrical hopper 122 adjacent the opening 130 and the other end tracing a line on the cylindrical wall 132 beginning from adjacent the top of the opening 130 and continuing around the interior cylindrical surface while descending in elevation to the bottom of the cylindrical wall 132. It is preferred that this sloped floor portion extends through the vertical axis of the cylindrical hopper so that the geometric center of the hopper floor is sloped toward the opening 130. This feature discourages build-up of a "pedestal" of material at the geometric center of the hopper 122 and helps to keep the material flowing toward the opening 130. As illustrated in FIGS. 10 and 11, the opening 130 in the floor 134 constitutes more than half but less than all of a quadrant of the floor. As also shown in FIGS. 10 and 11, the grinding fingers and grate assembly 70 is positioned in this partial quadrant opening 130, and the hammers 56 of the rotor assembly 40 protrude through the finger and grate assembly 70 into the hopper 122. As described briefly above, the fingers 72 extend essentially at floor 134 level radially into the milling chamber 30 in such a manner that the fingers 72 are essentially extensions of the floor portion 134. The quadrant of the cylindrical rotor surface subscribed by the rotating hammers 56 above the horizontal plane between the fingers 72 and the main shaft 42 extends through the opening 130 into the hopper portion 122. Thus, the material to be comminuted is fed substantially into this rotor quadrant above the fingers 72 located essentially in the hoper portion 122 of the tub feeder assembly 120.

The rotatable tub assembly 124 is comprised primarily of a tub 125 that has an open top and an open bottom positioned over the top rim 142 of the hopper 122. As briefly mentioned above, this tub 125 is adapted to rotate in the direction indicated by arrow 129 atop the hopper 122. A drive belt 150 passing around the periphery 125 just over the flange 144 imparts the rotary motion of hydraulic motor 116 to the tub 125.

With principle reference to FIG. 12, the tub 125 is rotatably positioned and retained atop the hopper 122 by a plurality of horizontal, grooved wheels 140 spaced around the perimeter of the hopper 122. These grooved wheels 140 are actually in the form of a conventional sheave or pulley having a deep groove in its peripheral surface; however, they do not function in the manner of an ordinary V-belt pulley. Instead, as shown in FIG. 12, these pulleys 140 are rotatably mounted on a vertical shaft 148 that is affixed to a horizontal bracket 146 extending outwardly from the rim 142 of hopper 122. A circular flange 144 extending radially outward from the bottom of the tub 125 protrudes into the peripheral groove of the pulley 140 where it is captured and restrained from vertical movement. However, rotation of the tub 125 by belt 150 causes the circular flange 144 to rotate the pulley 140. In this manner, the plurality of pulleys 140 positioned around the periphery of the hopper 122 support the weight of the tub 125 while allowing rotary motion of the tub 125.

A stirring bar or agitator assembly 156 is also illustrated in FIG. 12 as comprising an elongated, slightly curved bar or pipe 154 pivotally mounted at its upper or proximal end on a pin 155 in a bracket 156 on the interior wall or surface of the rotatable tub 125. The bar 154 can pivot upwardly and downwardly between the limits shown in FIG. 12 in order to allow some yielding movement to a possible jam or relatively immoveable chunk or bunch of material in the tub 125. The lower limit of this pivotal movement is defined by a lower limit pin 157 extending through the bracket 156. The upper limit, is shown in broken lines at 154', defined by a bar 158 extending across the front of the bracket 156. This agitator bar 154 is designed to extend from the side wall of the tub 125 inwardly and downwardly into the hopper 122 to stir and continually urge movement of material deposited therein in the circular direction of the rotating tub toward the opening 130.

The rotary motion of the tub 125, as indicated by the arrow 129 in FIGS. 10 and 11, in combination with the curved downward slant on the inclined floor portion 136 tends to feed the material essentially in the spiral pattern illustrated by the arrow 128 tangentially into the opening 130 of the milling chamber where it is fed radially into the hammers 56 of the rotor assembly 40 where they extend through the opening 130 into the hopper portion 122, as described above. As also described above, the feed rate is controlled and metered by the combination of the grinding finger and grate assembly 70 and the self-sharpening end points 58 on the hammers 56 to obtain a smooth continuous flow of material into the milling chamber 30. This arrangement has been tested and found to be very effective for continuously feeding hay and straw into the hammer mill, particularly in the form of conventional square or round bales of a standard size (approximately 55 to 95 pounds) normally within the capability of a person to handle by hand or with a small loading machine.

If desired, as shown in FIG. 11, a scraper assembly 170 can be used to scrape material off the inside surface of the tub 125 to prevent build-up. The scraper assembly 170 comprises a support bar 172 extending upwardly on the outside of the tub 125 from a mounting on the housing 126 or hopper 122 (not shown) and an internally downwardly extending bar 174 with a flexible or resilient scraper 176 mounted thereon. Again, this scraper assembly is optional and can be mounted and removed as desired, depending on the type of material, moisture content and other parameters that could make its use desirable.

While the arrangement illustrated in FIGS. 10 and 11 is primarily designed for feeding hay, either loose or in the form of conventional, man-sized bales, into the hammer mill, this small-scale hammer mill apparatus 10 is also specifically designed and intended for use in grinding and comminuting most other kinds of feed materials and feed grains that are utilized by small-scale livestock feeding operations. Therefore, several accessories to enhance such use are also provided as a part of this invention.

Figure 13:
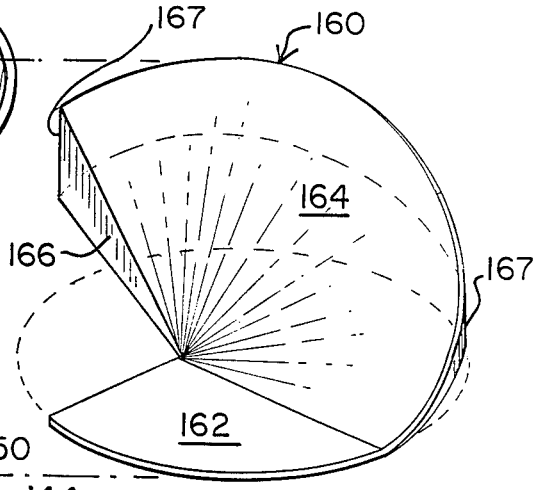
FIG. 13 is a perspective view of an auxiliary hopper bottom insert for the tub feeder assembly.

FIG. 13 illustrates a hopper floor insert 160 that is designed for positioning in the bottom of the hopper 122 over the existing floor therein to increase the inclined slope thereof. When in position, the flat portion 162 of insert 160 is positioned over the flat floor portion 134 of the hopper 122, and the curved, inclined platform portion 164 is positioned over the existing curved inclined floor portion 136, the side 166 extends the side wall of the opening 130 upwardly to the steeper incline of this sloped floor insert 160. The curved vertical side wall 167 is in the form of a partial helix, the bottom of which matches the outer edge of the sloping surface 136 and the top of which supports the outer edge of the inclined portion 164. This steeper inclined sloping floor insert 160 is particularly beneficial for feeding materials that do not flow very readily, such as ear corn and materials of similar characteristics, into the hammer mill.

Figure 14:
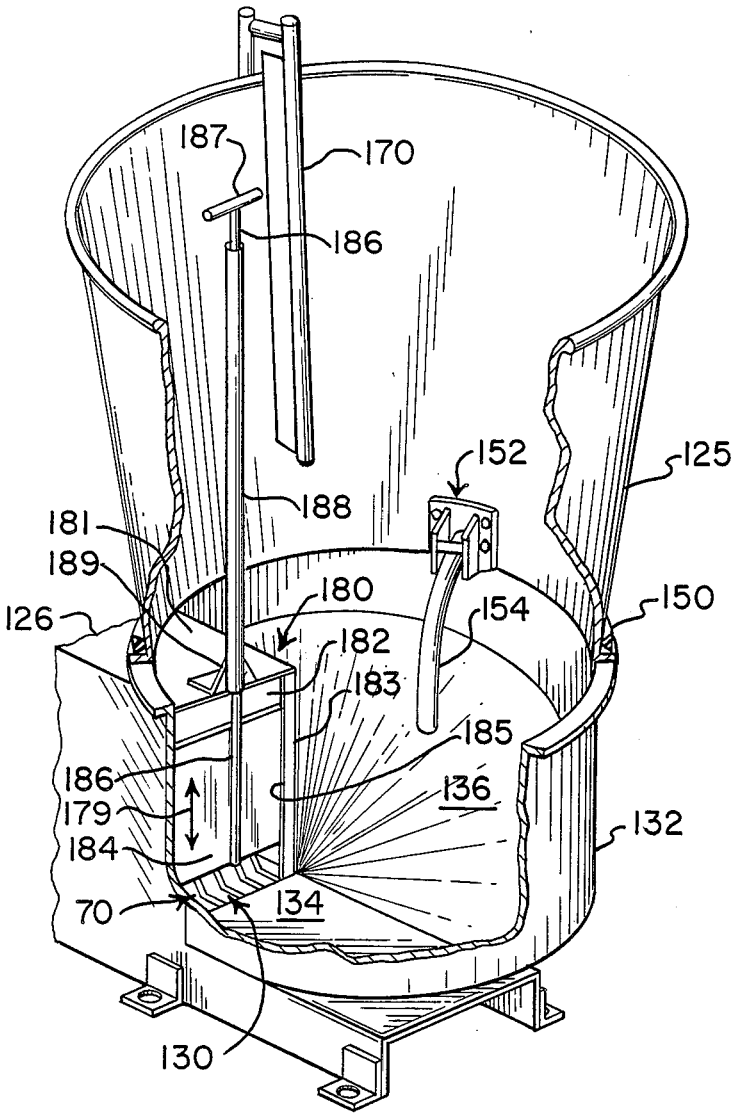
FIG. 14 is a perspective view similar to FIG. 13, but with an auxiliary grain door according to the present invention positioned over the opening to the hammer mill housing.
Figure 15:
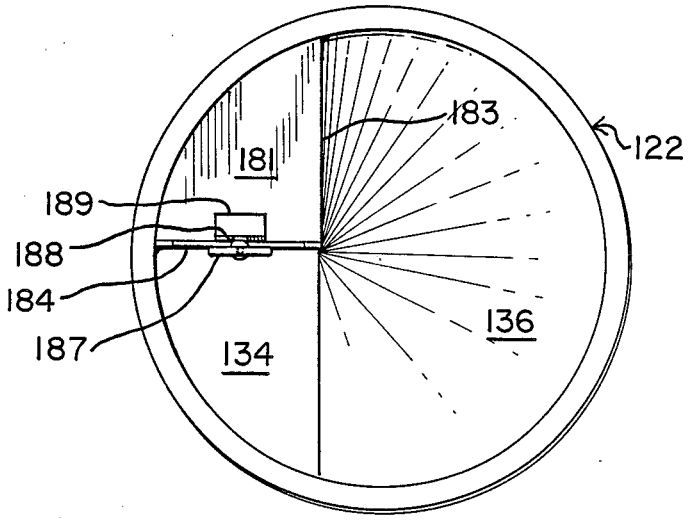
FIG. 15 is a plan view of the bottom of the hopper of FIG. 14 with the auxiliary grain door in position therein.

On the other hand, other small grains, such as wheat, barley, oats, shell corn, and the like, rather than requiring further urging from a steeper incline, instead require more flow control to prevent overloading of the hammer mill. While the spaced-apart grate bars 75 of the finger and grate assembly 70 are very effective for controlling the feeding of fibrous materials such as hay, straw, corn stalks, and the like into the milling chamber 30, they are spaced too far apart to effectively meter or control the flow of small grains therein. Therefor, the grain door assembly 180 illustrated in FIGS. 14 and 15 is provided to further meter and control the flow of small grains into the opening 130.

This grain door assembly 180 is comprised of a partial box like structure that has a top 181, front 182, and side 183, sized and formed to substantially cover and enclose the opening 130. A vertically slideable door 184 is positioned over the front panel 182 and is slideably retained thereover by guide retainers 185. This door 184 is adapted to slide upwardly and downwardly, as indicated by arrow 179, to substantially restrict the size of the opening 130 to the appropriate or desired extent to control or meter the flow of small grains into the opening 130. For ease of adjusting the size of the opening 130, even when the hopper 122 and tub 125 are full of grain, a vertical rod 186 is attached to the door 184 and extends upwardly through a vertical support guide 188 to approximately the top of tub 125. The support guide 188 is affixed to the top panel 181 of the grain door assembly 180 by a bracket 189. The top of the rod 186 has a convenient handle 187 affixed to the top thereof for convenient operation of the door form the top of the tub 125.

When feeding small grains and other materials that flow so readily as to require this auxiliary grain door assembly 180 to meter the flow into the hammer mill, the additional urging of a rotating tub 125 is not usually required. Therefore, when feeding such small grains into the hammer mill, the valve 114 shown in FIGS. 1 and 2 can be shut off to prohibit flow of hydraulic fluid to the motor 116, thereby disabling or stopping the rotary motion of the tub 125. With the tub 125 not rotating, the agitator assembly 152 will not interfere with the positioning or the functioning of the grain door assembly 180.

An additional feature of a small-scale cyclone energy dissipator according to this invention is shown in FIGS. 16 through 18. As is often the case, primarily when using the hammer mill apparatus 10 of this invention for grinding or comminuting small grains, corn, and the like, it is desirable to deposit the comminuted feed product into a truck, trailer, feed bin, or other receptacle. Without something to dissipate the force of the material exiting a hammer mill, along with the high speed, pressurized air flow exiting the hammer mill, it is extremely impractical to deposit the comminuted feed products in a receptacle without substantial loss of material due to the blowing and force of the exiting material. Cyclones are often utilized to dissipate the energy of the exiting product before depositing it into the desired receptacle. However, it would be impractical to hang a large-scale conventional cyclone on the end section 22 of the spout 21 of this small-scale comminuting apparatus 10. The cyclone according to this invention illustrated in FIGS. 16 through 18 includes some modifications that allow downsizing the cyclone and still obtaining the required pressure dissipation without loss of ground product.

The cyclone of this invention is comprised of a cylindrical side wall 191 with its axis oriented substantially vertically. The top of the cylinder is closed by a top panel 198, except for a vent 194 opening upwardly around the vertical axis of the cylindrical wall 191. A frustoconical funnel 192 extends downwardly and axially inwardly from the bottom of the cylindrical portion 191. The bottom of the frustoconical section 192 is truncated to form an opening 193 at the bottom thereof.

The cylindrical side wall portion 191 has a plurality of small openings 195 extending through the cylindrical side walls 191 from the interior to the exterior. These openings 195 are partially covered by louvered covers 196 that are slanted from the openings 195 inwardly to the cylindrical wall 191 in a direction substantially the same as the direction of flow of the product material in the cyclone, as illustrated schematically by the arrow 199 in FIG. 18.

The ground product, along with a high velocity flow of air, enters the cyclone 190 from the end section 22 through the opening 197, as indicated by the arrow 301 in FIG. 17. Inside the cyclone 190, the ground product material is retained within the cylindrical walls 191 as it circles the interior of the cyclone losing its kinetic energy and eventually spiralling downwardly into the funnel section 192, as indicated by the arrow 199 in FIG. 18. Having essentially lost its kinetic energy, the product P falls by gravity out the bottom opening 193, as illustrated in FIG. 17.

The air pressure blown into the cyclone by the hammer mill is dissipated to some extent through the top vent 194 in a conventional manner, as indicated by the arrow 302 in FIG. 17. In addition, a substantial amount of the air pressure is dissipated through the plurality of small, louvered openings 195 in the cylindrical side wall 191, as illustrated by arrows 303 in FIGS. 17 and 18. As mentioned briefly above, the louvered covers 196 over the openings 195 must be slanted inwardly in the same direction as flow of the product inside, as indicated by arrow 199 in FIG. 18. In this manner, product particles traveling at high speed around the interior surface of the cylindrical wall 191 are deflected inwardly by the louvered covers 196, while the air pressure inside the cyclone is dissipated to the exterior through the openings 195. Therefore, there is created a substantial air flow from the interior of the cyclone to the exterior, which air flow at each of these louvered openings 195 is counter to the direction of particle flow inside. Consequently, while the slant of the louvered covers 196 keep the product particles captured inside the cylindrical wall 191, the counter flow of air currents at each of the louvered openings 195 act both to relieve and dissipate air pressure inside the cyclone 190, as well as to more rapidly decelerate the ground product in the cyclone so that it will fall to the bottom and exit the opening 193 in less time than would otherwise be required.

The wood feeder assembly 200 of the present invention is shown mounted on the hammer mill 10 in FIGS. 19 through 22. The mounting ears 208, 209 of the wood feeder assembly 200 are positioned to mount on the frame 12 of the hammer mill apparatus 10 in the same places and with the same fasteners as the mounting ears 127, 109 of the tub feeder assembly 120, as described above. Likewise, the hydraulic lines to the motor 118 can be connected directly to the couplers 113, 115 of the main hydraulic system, as were the hydraulic lines for the motor 116 of the tub feeder assembly. Therefore, the wood feeder assembly 200 is readily interchangeable with the tub feeder assembly 120 by removal of only a relatively few mounting bolts and quick interchange of hydraulic lines, to convert the hammer mill 10 from use for grinding feed to use for chipping wood for livestock bedding, mulch, and other uses convenient to the small-scale livestock feeding operation.

Figure 20:
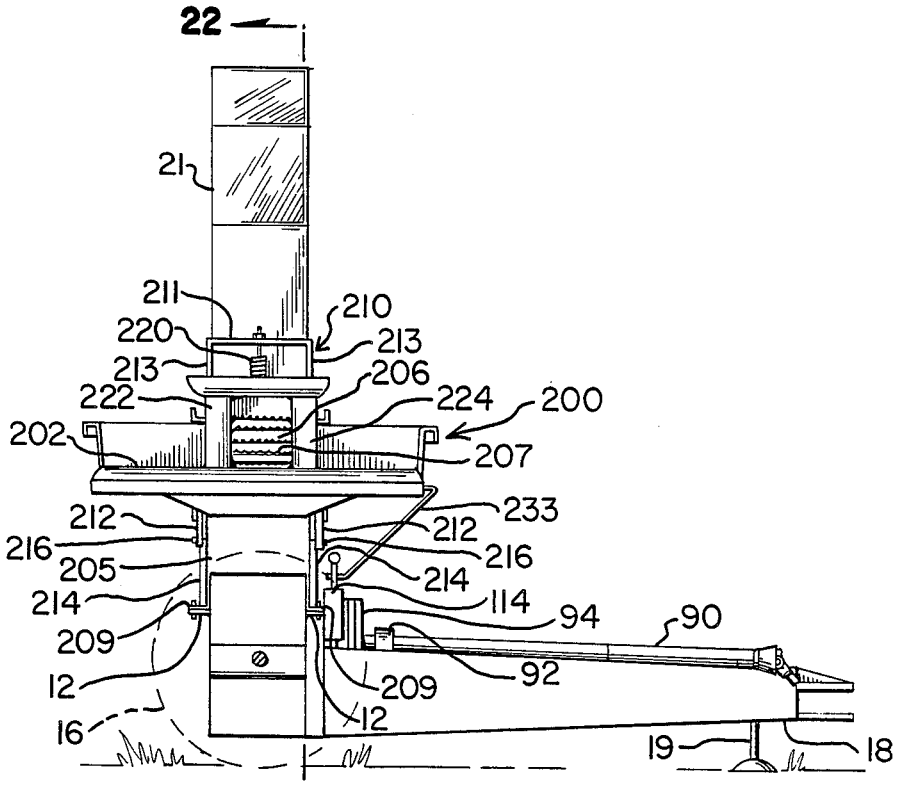
FIG. 20 is a right side elevation view of the hammer mill according to the present invention with the wood feeder assembly mounted thereon.
Figure 19:
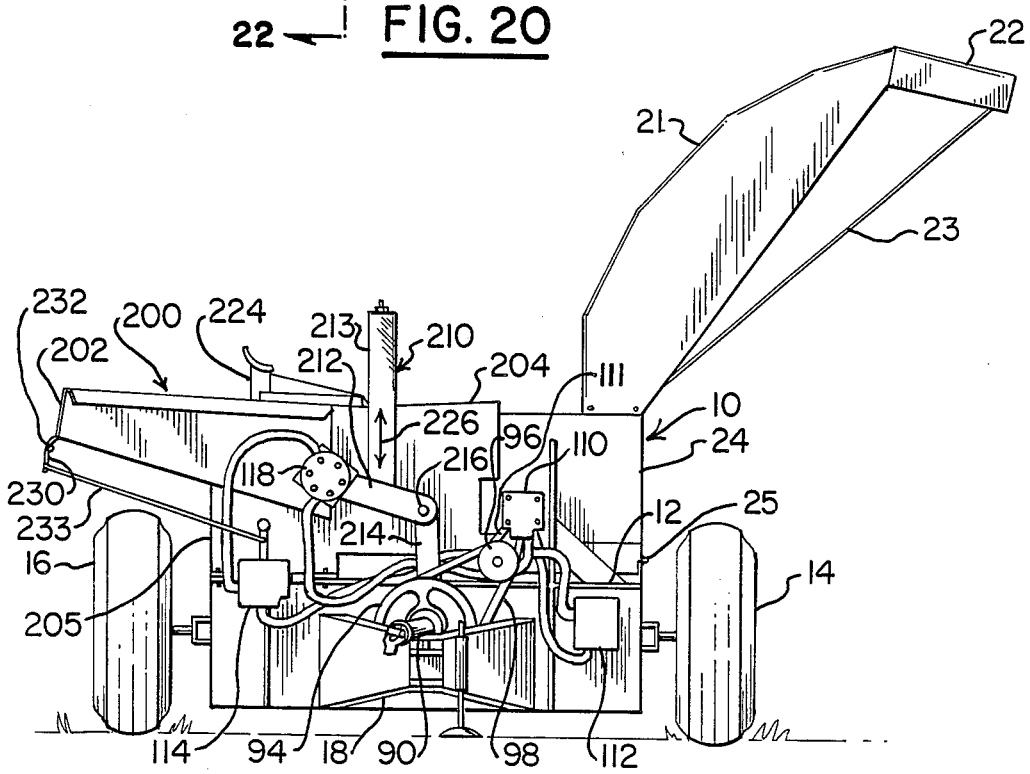
FIG. 19 is a front elevation view of the hammer mill according to the present invention similar to the front elevation view in FIG. 2, except with the wood feeder assembly mounted on the hammer mill instead of the tub feeder assembly.
Figure 21:
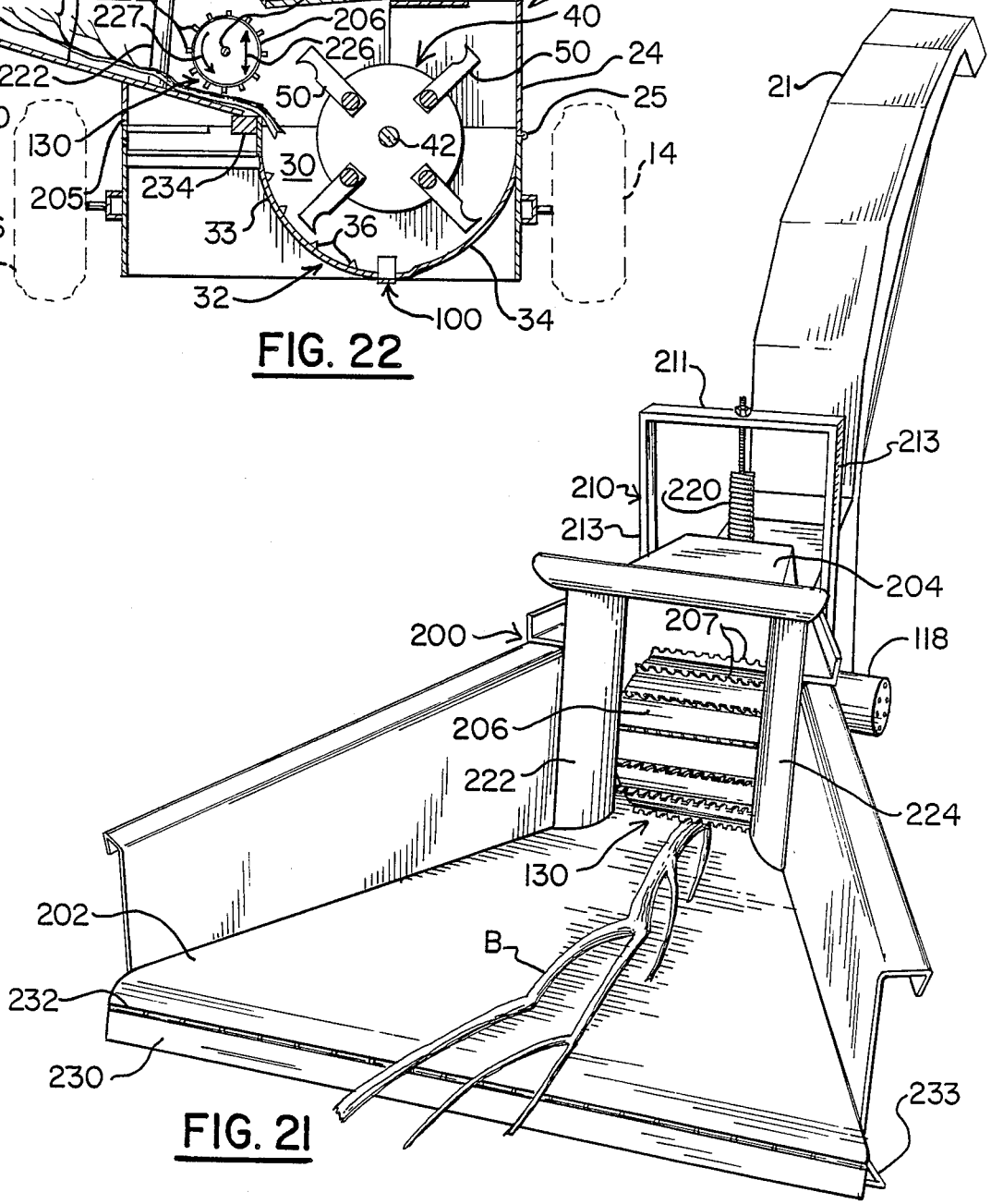
FIG. 21 is an enlarged perspective view of the wood feeder assembly of the present invention.

Referring now to FIGS. 19 through 21, the wood feeder assembly 200 is comprised primarily of a chute 202, rotor housing 204, and feeder drum 206. The feeder housing 204 partially encloses the portion of the rotor assembly 40 that is not enclosed by the housing section 24, and the base 205 encloses the grinding bar or finger area under the chute 202 and provides a structure for the mounting ears 209. The feed drum 206 is mounted on a transverse shaft 218 and is positioned in the opening 130 to the milling chamber 30. The feeder drum 206 substantially fills the opening 130 and is driven by the hydraulic motor 118 connected to the drum shaft 218. A plurality of tooth bars protrude outwardly from the peripheral surface of the cylindrical drum 206 to assist the drum 206 in its function of engaging and controlling or metering the feeding of wood branches B into the milling chamber 30.

Figure 22:
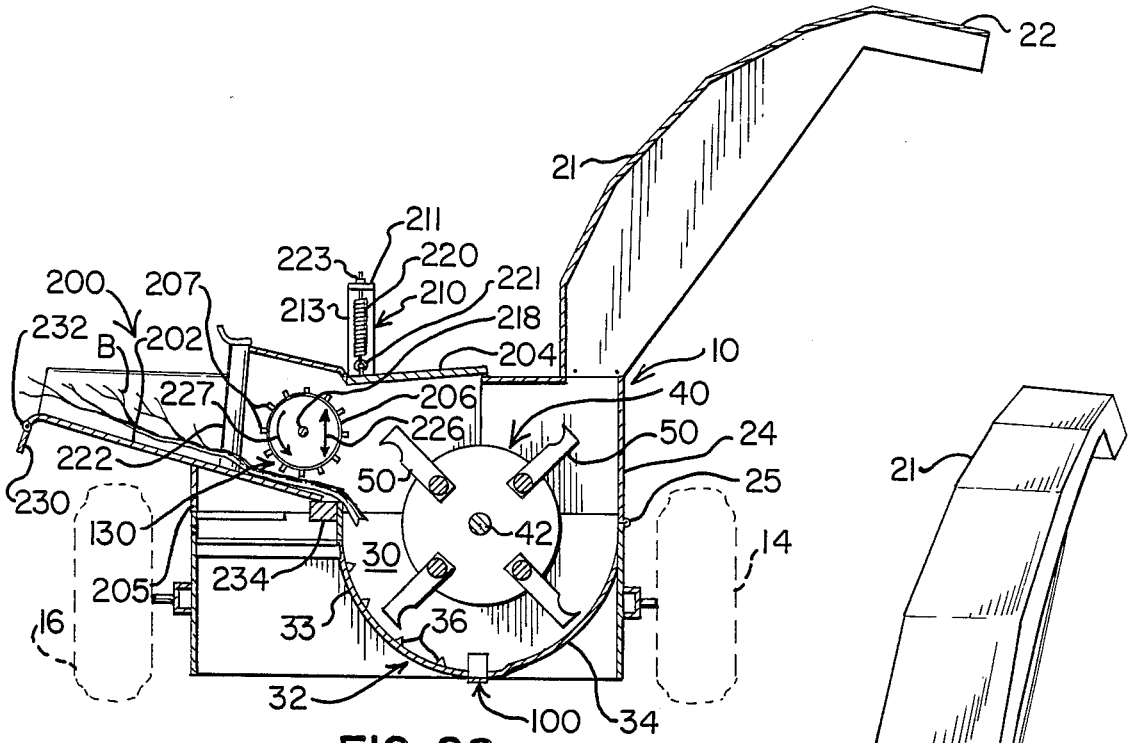
FIG. 22 is a cross sectional view of the hammer mill according to the present invention with the wood chipper assembly mounted thereon, taken substantially along lines 22—22 of FIG. 20.

The drum 206 and its shaft 218 are mounted in such a manner that the drum 206 not only rotates under the power of the motor 118 in the direction of the arrow 227, but also so that it can move vertically up and down as indicated by the arrow 226 in FIG. 22. Such vertical movement of the drum accommodates the feeding of various sized branches B into the hammer mill, while still maintaining its engagement with branches of all sizes being fed therein.

The engagement of the teeth on the branches B is further enhanced and maintained by a spring bias that provides a constant, strong, downwardly directed force on the shaft 218 of the drum 206. This downward bias is provided by a coiled tension spring 220 and a bias frame 210. The bias frame 210 is comprised of a pair of arms 212 pivotally mounted respectively on the front and back sides of the housing 204. One end of each arm 212 is pivotally attached by pins 216 to a respective one of the pair of anchors 214 extending upwardly from frame members 12 on either side of the housing 204. Vertical members 213 on opposite sides of the housing 204 are rigidly attached to the respective arms 212 and extend upwardly to a cross bar 211 positioned a spaced distance above the top of the housing 204.

The coiled spring 220 is anchored at 221 to the top of the housing 204 and at 223 to the cross bar 211. Therefore, through this bias frame 210, the spring 220 always applies a strong, downward force on the rotor 206. This downward bias yields to the various thicknesses of branches B passing down the chute 202 and under the roller 206 into the milling chamber 30, it causes the tooth bars 207 to maintain a strong gripping engagement with the branches B. In this manner, the branches B are fed into the milling chamber 30 at precisely the rate determined by the rotation of hydraulic motor 118.

In addition to this feeding or metering function of the feed drum 206, the position of the feed drum 206 in the opening 130 also tends to inhibit pieces of wood from being carried by the hammers 56 all the way around the milling chamber 30 from being thrown in a reverse direction outwardly through the opening 130. A pair of guide bars 222, 224 positioned on opposite sides of the opening 130 also tend to restrict the opening, as well as to guide the branches B away from the sides of the feed drum 206 where they could become wedged between the ends of the feed drum 206 and the sides of the housing 204.

The hammer mill 10 according to this invention with the wood feeder assembly 200 mounted thereon can be used with the finger and grate assembly 70 described above and illustrated in FIGS. 5 and 6, or it can also be used with the alternate embodiment finger assembly described above and shown in FIG. 7. However, it has been found that, depending to some extent on the nature of the brush or branches being fed into the hammer mill 10, there can be sufficient chipping or comminuting by replacing the fingers 72 with a rather large, strong transverse breaker bar 234 positioned at the intersection of the chute 202 with the milling chamber 30, as illustrated in FIG. 22. In this embodiment, the branches B are initially broken into short pieces over the breaker bar 234 by the hammer assemblies 50. These pieces are then initially ground over the concaves 36 in the primary section 33 of the lower chamber wall 32, and they are finally ground through the secondary finger assembly 100 at the bottom of the milling chamber 30. For most common applications, this embodiment provides sufficient comminuting to produce wood chips small enough to be useful for livestock bedding, mulching, and other purposes. However, if finer chips are desired, the finger and grate assemblies described above can be utilized. Also, the removable outlet screen 38 described above, but not shown in FIG. 22, can also be used.

A shut-off bar 230 is pivotally mounted by hinge 232 to extend downwardly from the distal end of the chute 202. This shut off bar 230 is connected by rod 233, shown in FIGS. 19 and 20, to the hydraulic control valve 114. Therefore, an operator standing in front of the chute can readily push the bar 230 with his hand, foot, or otherwise to stop the hydraulic motor 118 driving the feeder drum 206.

The foregoing description is considered as illustrative only of the principles of the invention. Further, since numerous modifications and changes will readily occur to those skilled in the art it is not desired to limit the invention to the exact construction and processes shown and described above. Accordingly, all suitable modifications and equivalence my be resorted to falling within the scope of the invention as defined by the claims which follow.

The embodiments of the invention in which an exclusive property or privilege is claimed are defined as follows:

1. Hammer mill apparatus for comminuting fodder, feed grains, and wood materials, comprising:

a rotor assembly, including a horizontal main shaft that defines the axis of rotation of said rotor assembly and a plurality of hammers extending radially outward at the periphery of said rotor assembly;

a frame extending adjacent opposite axial ends of said rotor assembly, opposite ends of said main shaft being journalled on said frame;

a main housing on said frame partially enclosing said rotor assembly in a milling chamber;

rotor drive means connected to said rotor assembly for imparting high angular velocity rotary motion to said rotor assembly;

detachable tub feeder means adapted for mounting on said frame adjacent said rotor assembly for feeding materials to be comminuted into said milling chamber, said tub feeder means including a hollow rotatable receptacle positioned over a portion of said rotor assembly not enclosed by said main housing; and alternate detachable drum feeder means adapted for mounting on said frame adjacent said rotor assembly for feeding materials to be comminuted into said milling chamber, said drum feeder means including an inclined chute extending radially toward the portion of said rotor assembly not enclosed by said main housing and a cylindrical feed drum positioned at about the intersection of said chute with said milling chamber for engaging and metering said material into said milling chamber.

2. The hammer mill apparatus of claim 1, wherein said tub feeder means includes hopper means under said hollow rotatable receptacle for enclosing the bottom of said rotatable receptacle and for guiding said material toward said rotor assembly, said hopper means having a vertical cylindrical sidewall extending downwardly from the bottom of said hollow receptacle, an open top, a closed bottom, and an opening extending through a portion of said bottom and through a portion of said vertical cylindrical sidewall with an unenclosed portion of said rotor assembly extending through said opening into said hopper means.

3. The hammer mill apparatus of claim 2, wherein the floor of said hopper means adjacent said opening is approximately aligned with a horizontal plane passing through the axis of rotation of said rotor assembly and said cylindrical sidewall extends upwardly from said floor at least as high as the top of said rotor assembly, said opening in said hopper means extending horizontally into said floor and vertically through said sidewall approximately as high as the top of said rotor assembly.

4. The hammer mill apparatus of claim 3, wherein a side of said opening forms a housing section that extends tangentially from said cylindrical sidewall toward said milling chamber and the opposite inner side of said opening is parallel to said tangentially extending housing and is positioned between the tangentially extending housing and the radius of the circular floor that is parallel to said tangential housing.

5. The hammer mill apparatus of claim 4, wherein a portion of the floor of said hopper means slopes from a higher position adjacent said inner side of said opening toward a lower position adjacent the tangential side of said opening.

6. The hammer mill apparatus of claim 4, wherein the sloping portion of said floor is defined by a surface generated by a line segment, one end of which is fixed adjacent the innermost point of said opening in said floor and the other end of which subscribes a helical line from said higher position adjacent said inner side around the inside surface of said cylindrical sidewall in a constantly decreasing elevation to a point on the sidewall at the bottom of the hopper means approaching said tangential side of said opening.

7. The hammer mill apparatus of claim 6, including a removeable insert for positioning over said floor of said hopper means for providing a steeper slope to the bottom of said hopper means, said removeable insert having a raised platform surface inclined spirally downward in generally the same pattern, but at a steeper slope, as the sloped floor portion of said hopper means.

8. The hammer mill apparatus of claim 4, wherein said sloping portion of the floor crosses over and covers the axial center of the bottom of said hopper means so that more than half the floor of said hopper means is sloped toward said opening.

9. The hammer mill apparatus of claim 8, wherein said hollow rotatable receptacle rotates above said hopper means about a vertical axis of rotation extending through the cylindrical axis of said hopper means and in the direction corresponding with said downwardly sloping floor surface to move material in said receptacle and hopper in a whorl pattern spiraling downwardly toward said opening and into said rotor assembly positioned partially in said opening.

10. The hammer mill apparatus of claim 9, wherein said hammers are in the form of elongated bars that extend radially outward from the periphery of said rotor assembly, and wherein said hammers are mounted in a plurality of gangs, each gang having a plurality of hammers, said gangs being evenly distributed around the periphery of the rotor assembly to maintain a dynamic balance of the rotor assembly, and the hammers in each gang being spaced axially apart from each other.

11. The hammer mill apparatus of claim 10, including a plurality of rigid, spaced-apart grinding fingers extending in said horizontal plane in said opening from under the floor of said hopper means radially toward said rotor assembly, said fingers being aligned so that each of the hammers in a gang can pass between two of said fingers.

12. The hammer mill apparatus of claim 11, including a plurality of elongated grate bars that extend at an incline upwardly from the ends of said fingers nearest said rotor a sufficient distance to traverse substantially the height of said opening through said sidewall, said grate bars being spaced-apart from each other the same as the spacing between said fingers to allow said hammers to extend between said grate bars into said hopper means.

13. The hammer mill apparatus of claim 12, wherein said fingers and grate bars are adjustable radially toward and away from said rotor assembly to selectively vary the extent to which said hammers protrude through said grate into said hopper means.

14. The hammer mill apparatus of claim 13, wherein each of said elongated hammers has a proximal end connected to said rotor assembly, a distal end extending radially outward from said rotor assembly, and a leading edge along the length of said hammer between the proximal and distal ends that is oriented to the direction of rotation of the rotor assembly, said hammer also having a crescent-shaped recessed portion in the leading edge that causes a hook-like point at the intersection of the leading edge with the distal end.

15. The hammer mill apparatus of claim 14, wherein said hook-like point on said distal end is self-sharpening.

16. The hammer mill apparatus of claim 15, wherein said hook-like point is fabricated of a material that is harder and more resistant to wear than the remainder of the leading edge.

17. The hammer mill apparatus of claim 12, wherein said housing includes a curved bottom wall that has a radius of curvature slightly larger than the maximum radius of said rotor assembly and extends from said fingers at least 180 degrees around the bottom periphery of said rotor assembly, and a set of removeable secondary grinding fingers extending upwardly through an opening in the bottom of said curved bottom wall, said set including a plurality of secondary fingers in axially spaced-apart relation to each other and extending radially toward said rotor assembly, said secondary fingers being aligned to allow said hammers to pass through the spaces between said secondary fingers as said rotor assembly rotates.

18. The hammer mill assembly of claim 17, said secondary grinding fingers being rigidly attached to, and extending upwardly from an elongated mounting plate that covers said opening in the bottom wall, said set also being removeably mountable in a reverse position with the secondary fingers extending downwardly from said mounting plate outside said milling chamber with said mounting plate covering said opening in said bottom wall.

19. The hammer mill assembly of claim 9, wherein said rotatable receptacle has an annular flange extending radially outward from the periphery of said receptacle adjacent its lower end and wherein there are a plurality of horizontal support wheels on a vertical shaft, said wheels being mounted in angularly spaced apart relation around the upper periphery of the cylindrical sidewalls of said hopper means, each of said support wheels having an annular flange being inserted in the grooves of said support wheels.

20. The hammer mill assembly of claim 19, including tub drive means with a V-belt drive pulley mounted on said hopper means and a V-belt looped around the periphery of said rotatable receptacle and around said pulley for imparting rotary motion to said receptacle.

21. The hammer mill apparatus of claim 2, including an agitator bar attached to the inside surface of said rotatable receptacle and extending inwardly and downwardly into said hopper means for stirring and agitating materials deposited therein to be comminuted in an angular direction corresponding to the rotation of said receptacle, said agitator bar having a proximal end and a distal end, said proximal end having a pivotal mounting to said receptacle that allows pivoting of said agitator bar between a higher position and a lower position.

22. The hammer mill apparatus of claim 2, including a grain door enclosure positioned in said hopper means and comprising top, side, and front wall means for covering and enclosing said opening and said portion of said rotor assembly extending through said opening, said front wall having a door opening therethrough and a door panel mounted thereon, said door panel being slideable over said door opening.

23. The hammer mill apparatus of claim 22, including handle means connected to said door for sliding said door between an open position and a closed position, said handle means including an elongated rod, one end of which is attached to said door and the other end of which extends upwardly from said door to the top of said receptacle, and hollow cylindrical guide means attached to said grain door enclosure for supporting and restraining said elongated rod against horizontal movement while allowing vertical movement of said rod therethrough.

24. The hammer mill apparatus of claim 1, including hollow discharge spout means connected to said housing and opening into said milling chamber for conducting comminuted material out of said milling chamber, wherein high velocity rotation of said rotor assembly in said milling chamber propels the comminuted material in a high velocity air stream into said spout means.

25. The hammer mill apparatus of claim 24, including screen means removeably positioned in the opening of said spout means into said milling chamber for prohibiting comminuted material particles greater than a predetermined size from entering said spout means.

26. The hammer mill apparatus of claim 25, including energy dissipating means mounted on said spout means for dissipating the kinetic energy and air of said high velocity comminuted material and air stream, said energy dissipating means comprised of a cyclone having a hollow cylindrical wall portion with a substantially vertical axis, a frustoconical funnel section extending from the bottom of said cylindrical wall portion downwardly and inwardly to an opening at the bottom of said funnel section, a top panel enclosing the top of said cylindrical wall portion, said cylindrical wall portion having a large inlet opening adjacent its upper rim with said spout means connected to said cylindrical wall portion around said inlet opening in such a manner that it directs the high velocity stream of air and comminuted material tangentially into said cylindrical wall portion to flow in a downwardly spiralling pattern around the inside surface of said cylindrical wall portion, said cylindrical wall portion also having a plurality of smaller louvered openings therethrough with fins over said louvered openings slanted inwardly in the direction of the spiralling flow of comminuted material to allow air to escape from the interior of said cyclone, while preventing comminuted material from escaping through said louvered openings.

27. The hammer mill apparatus of claim 1, wherein said detachable drum feeder means includes a feeder housing portion that mounts over and encloses said portion of said rotor assembly not enclosed by said main housing and defining a feeder opening into said milling chamber that is spaced radially outwardly from the portion of said rotor assembly not enclosed by said main housing, the bottom of which opening is aligned with a horizontal plane that extends through said main shaft and the top of which aligns horizontally with the top of said rotor assembly, said feed drum being positioned in said opening with a spaced distance radially outward from said rotor assembly with said drive shaft parallel to said main shaft.

28. The hammer mill apparatus of claim 27, wherein said feed drum is mounted on a horizontal drive shaft with drum drive means connected to said shaft for rotating said feed drum at a preselected speed, said feed drum and said drive shaft also being moveable vertically and including vertical bias means connected to said drive shaft for yieldingly biasing said feed drum downwardly toward said chute.

29. The hammer mill apparatus of claim 28, wherein said bias means includes a pair of pivot arms, one of which is positioned on each side of the feeder housing and each of said pivot arms having a proximal end pivotally attached to said frame and a distal end attached to said drive shaft, a pair of vertical bias frame members connected to and extending upwardly from said pivot arms, a cross member connecting said respective bias frame members a spaced distance above said feeder housing, and a coiled tension spring connected at its one end to said cross member and anchored at its other end to said feeder housing.

30. The hammer mill apparatus of claim 29, wherein said chute has a proximal end where it joins said milling chamber and a distal end extending radially outward in relation to said rotor assembly, and said drive means includes a hydraulic motor and hydraulic valve means for regulating the flow of hydraulic fluid to said hydraulic motor, and including a control bar in the form of an elongated rectangular flap hinged to the distal end of said chute with an elongated control rod connected at one end to said control bar and at the other end to said valve means for terminating flow of hydraulic fluid to said hydraulic motor upon pivotal movement of said control bar.

31. The hammer mill apparatus of claim 1, including breaker means at the intersetion of said chute with said milling chamber for supporting a branch as said rotor assembly breaks the branch into short pieces.

32. The hammer mill apparatus of claim 31, wherein said breaker means includes a rigid bar positioned parallel to said main shaft a spaced distance radially outward from the periphery of said rotor assembly.

33. Comminuting apparatus for comminuting hay, corn, and feed grain materials, comprising:

a rotary hammer mill having a plurality of hammer means for tearing, grinding, and breaking material to be comminuted, said hammer means being positioned a radial distance outward from a horizontal rotor axis and distributed at angularly spaced distances from each other around said rotor axis to maintain a dynamic balance when said rotary hammer mill is in operation, and rotor drive means for imparting rotary motion to said hammer mill causing said hammer means to rotate at high angular velocity about said rotor axis, the radial extremities of said hammer means as they rotate about said rotor axis defining the surface of a rotor cylinder that has a front end and a back end, the axial length of said rotor cylinder between the front end and the back end being less than the radius of the rotor cylinder;

tub feeder means adjacent said rotary hammer mill for feeding material to be comminuted into the rotary path of said hammer means, said tub feeder means including hopper means for containing and guiding the material into the rotary path of said hammer means, said hopper means being comprised of a container having a cylindrical side wall with a substantially vertical axis and a radius at least as large as said axial length of said rotor cylinder, an open top end, and a closed bottom end, said hopper means also having a feeder opening through a portion of the bottom and cylindrical side wall with a portion of said rotor cylinder protruding through said feeder opening into said hopper means in such a manner that a vertical plane congruent with the back end of the rotor cylinder is tangential to the cylindrical sidewall of said hopper means and the portion of the circular front end of the rotor cylinder protruding through said opening into said hopper means being a portion of a segment of said circular front end defined by a vertical chord;

said tub feeder means also havign a rotatable tub positioned over said hopper means, said tub being rotatable about a substantially vertical axis that is an extension of the vertical axis of the cylindrical side wall of said hopper means, and tub drive means for imparting rotary motion to said tub to urge material therein in a rotary motion away from said portion of the circular front end of the rotor cylinder in said hopper means and toward said portion of the cylindrical rotor surface that is in said hopper means.

34. The comminuting apparatus of claim 33, wherein said portion of said segment of the circular front end of said rotor cylinder in said hopper means is above a horizontal radius of said circular front end that extends through said segment.

35. The comminuting apparatus of claim 34, wherein said rotary hammer mill rotates in a direction such that the hammer means enter said hopper means through the portion of said feeder opening in the cylindrical side wall and exit said hopper means through the portion of said feeder opening in the bottom end of said hopper means.

36. The commminuting apparatus of claim 35, including a plurality of rigid griding fingers extending from under the bottom end of said hopper means radially into said rotor cylinder, said grinding fingers being horizontally spaced apart from each other, and said hammer means including a plurality of hammers spaced apart from each other in a direction parallel to said horizontal rotor axis a sufficient distance so that said hammers pass between said grinding fingers as they rotate about said rotor axis, and further including a plurality of grate bars extending upwardly and toward the vertical radius of said rotor cylinder from said grinding fingers.

37. The comminuting apparatus of claim 36, wherein said grinding fingers and grate bars are adjustably moveable toward and away from said rotor cylinder.

38. The comminuting apparatus of claim 37, wherein each of said hammers is an elongated bar that has a proximal end nearest said rotor axis, a distal end extending radially outward from said proximal end, and a leading edge directed toward the direction of rotation of said hammer means about said rotor axis, said leading edge having a recess therein adjacent the distal end forming a hook-like point at the intersection of said leading edge with said distal end, said hook-like point being substantially harder than the remaining leading edge to induce a decreased tendency of wear on said point as compared to the remaining leading edge, thereby to keep the point sharp and protruding in relation to the adjacent recessed portion.

39. Hammer mill apparatus for comminuting materials, comprising:

a rotor assembly, including a horizontal main shaft that defines the axis of rotation of said rotor assembly and a plurality of hammers extending radially outward at the periphery of said rotor assembly;

a main housing partially enclosing said rotor assembly in a milling chamber;

rotor drive means connected to said rotor assembly for imparting high angular velocity rotary motion to said rotor assembly;

tub feeder means adjacent said rotor assembly for feeding materials to be comminuted into said milling chamber, said tub feeder means including a hollow rotatable receptacle positioned over a portion of said rotor assembly not enclosed by said main housing and hopper means under said hollow rotatable receptacle for enclosing the bottom of said rotatable receptacle and for guiding said material toward said rotor assembly, said hopper means having a vertical cylindrical sidewall extending downwardly from the bottom of said hollow receptacle, an open top, a closed bottom, and an opening extending through a portion of said bottom and through a portion of said vertical cylindrical sidewall with an unenclosed portion of said rotor assembly extending through said opening into said hopper means.

40. The hammer mill apparatus of claim 39, wherein the floor of said hopper means adjacent said opening is approximately aligned with a horizontal plane passing through the axis of rotation of said rotor assembly and said cylindrical sidewall extends upwardly from said floor at least as high as the top of said rotor assembly, said opening in said hopper means extending horizontally into said floor and vertically through said sidewall approximately as high as the top of said rotor assembly.

41. The hammer mill apparatus of claim 40, wherein a side of said opening forms a housing section that extends tangentially from said cylindrical sidewall toward said miling chamber and the opposite inner side of said opening is parallel to said tangentially extending housing and is positioned between the tangentially extending housing and the radius of the circular floor that is parallel to said tangential housing.

42. The hammer mill apparatus of claim 41, wherein a portion of the floor of said hopper means slopes from a higher position adjacent said inner side of said opening toward a lower position adjacent the tangential side of said opening.

43. The hammer mill apparatus of claim 41, wherein the sloping portion of said floor is defined by a surface generated by a line segment, one end of which is fixed adjacent the innermost point of said opening in said floor and the other end of which subscribes a helical line from said higher position adjacent said inner side around the inside surface of said cylindrical sidewall in a constantly decreasing elevation to a point on the sidewall at the bototm of the hopper means approaching said tangential side of said opening.

44. The hammer mill apparatus of claim 41, wherein said sloping portion of the floor crosses over and covers the axial center of the bottom of said hopper means so that more than half the floor of said hopper means is sloped toward said opening.

45. The hammer mill apparatus of claim 44, wherein said hollow rotatable receptacle rotates above said hopper means about a vertical axis of rotation extending through the cylindrical axis of said hopper means and in the direction corresponding with said downwardly sloping floor surface to move material in said receptacle and hopper in a whorl pattern spiraling downwardly toward said opening and into said rotor assembly positioned partially in said opening.

46. The hammer mill apparatus of claim 39, including an agitator bar attached to the inside surface of said rotatable receptacle and extending inwardly and downwardly into said hopper means for stirring and agitating materials deposited therein to be comminuted in an angular direction corresponding to the rotation of said receptacle, said agitator bar having a proximal end and a distal end, said proximal end having a pivotal mounting to said receptacle that allows pivoting of said agitator bar between a higher position and a lower position.

47. The hammer mill apparatus of claim 39, including a grain door enclosure positioned in said hopper means and comprising top, side, and front wall means for covering and enclosing said opening and said portion of said rotor assembly extending through said opening, said front wall having a door opening therethrough and a door panel mounted thereon, said door panel being slideable over said door opening.

48. The hammer mill apparatus of claim 47, including handle means connected to said door for sliding said door between an open position and a closed position, said handle means including an elongated rod, one end of which is attached to said door and the other end of which extends upwardly from said door to the top of said receptacle, and hollow cylindrical guide means attached to said grain door enclosure for supporting and restraining said elongated rod against horizontal movement while allowing vertical movement of said rod therethrough.

49. The hammer mill apparatus of claim 41, including a removeable insert for positioning over said floor of said hopper means for providing a steeper slope to the bottom of said hopper means, said removable insert having a raised platform surface inclined spirally downward in generally the same pattern, but at a steeper slope, as the sloped floor portion of said hopper means.

50. Hammer mill apparatus for comminuting fodder, feed grains, wood materials, and the like, comprising:

a rotor assembly, including a horizontal main shaft that defines the axis of rotation of said rotor assembly and a plurality of hammers in the form of elongated bars extending radially outward at the periphery of said rotor assembly, said hammers being mounted in a plurality of gangs, each gang having a plurality of hammers, said gangs being evenly distributed around the periphery of the rotor assembly to maintain dynamic balance of the rotor assembly, and the hammers of each gang being spaced axially apart from each other;

a main housing partially enclosing said rotor assembly in a milling chamber;

rotor drive means connected to said rotor assembly for imparting high angular velocity rotary motion to said rotor assembly;

feeder means adjacent said rotor assembly for feeding materials to be comminuted into said milling chamber, said feeder means including a substantially planar platform floor positioned adjacent the periphery of the portion of said rotor assembly that is not enclosed by said main housing; and a combination metering and grinding assembly comprised of a plurality of rigid, spaced-apart grinding fingers extending from under the floor radially into said rotor assembly, said fingers being aligned so that each of the hammers in a gang can pass between two of said fingers, and a plurality of elongated grate bars that extend at an incline upwardly from the ends of said fingers nearest said rotor a sufficient distance to traverse substantially the height of said opening through said sidewall, said grate bars being spaced-apart from each other the same as the spacing between said fingers to allow said hammers to extend between said grate bars into said hopper means.

51. The hammer mill apparatus of claim 50, wherein said finger and grate bar assembly is adjustable to move said fingers and grate bars radially toward and away from said rotor assembly to selectively vary the extend to which said hammers protrude through said finger and grate bar assembly.

* * * * *